United States Patent [19]

White et al.

[11] Patent Number: 4,729,430

[45] Date of Patent: Mar. 8, 1988

[54] PRESSURE LIMITER FOR A DOWNHOLE PUMP AND TESTING APPARATUS

[75] Inventors: Kevin M. White, Jupiter, Fla.; Paul D. Ringgenberg, Duncan, Okla.

[73] Assignee: Halliburton Company, Duncan, Okla.

[21] Appl. No.: 923,800

[22] Filed: Oct. 27, 1986

[51] Int. Cl.[4] ..... F21B 47/00

[52] U.S. Cl. ..... 166/106; 166/250; 417/395

[58] Field of Search ..... 166/250, 68, 105, 106, 166/187, 191, 127, 130, 183; 417/395; 415/26

[56] References Cited

U.S. PATENT DOCUMENTS

| | | | |
|---|---|---|---|
| 2,690,224 | 9/1954 | Roberts | 166/120 |
| 2,952,217 | 9/1960 | Lindbom | 417/395 |
| 3,083,774 | 4/1963 | Peters et al. | 166/187 |
| 3,291,219 | 12/1966 | Nutter | 166/145 |
| 3,439,740 | 4/1969 | Conover | 166/250 |
| 3,637,328 | 1/1972 | Kurokawa et al. | 417/395 |
| 3,692,433 | 9/1972 | Finger | 417/395 |
| 3,876,000 | 4/1975 | Nutter | 166/106 |
| 3,876,003 | 4/1975 | Kisling, III | 166/250 |
| 3,926,254 | 12/1975 | Evans et al. | 166/106 |
| 4,246,964 | 1/1981 | Brandell | 166/106 |
| 4,313,495 | 2/1982 | Brandell | 166/53 |
| 4,320,800 | 3/1982 | Upchurch | 166/106 |
| 4,366,862 | 1/1983 | Brandell | 166/106 |
| 4,372,387 | 2/1983 | Brandell | 166/334 |
| 4,386,655 | 6/1983 | Brandell | 166/106 |
| 4,388,968 | 6/1983 | Brandell | 166/236 |
| 4,412,584 | 11/1983 | Brandell | 166/169 |
| 4,457,367 | 7/1984 | Brandell | 166/105 |
| 4,458,752 | 7/1984 | Brandell | 166/187 |
| 4,460,310 | 7/1984 | Plunkett | 415/26 |

OTHER PUBLICATIONS

Northstar Drillstem Testers, Ltd., Tool String Shown on p. 11 of the Sep. 1, 1980, edition of Oilweek.

*Primary Examiner*—Stephen J. Novosad
*Assistant Examiner*—William P. Neuder
*Attorney, Agent, or Firm*—James R. Duzan; Neal R. Kennedy

[57] ABSTRACT

A pressure limiter and pump for use in a testing string. The pressure limiter has an outer case and an inner mandrel which form an enclosure defining an annulus therebetween. The inlet and outlet check valves in the annulus define a pumping chamber therebetween which opens toward the pump. Fluid in the pumping chamber is never vented to the well annulus. In a first embodiment, a transversely mounted pressure limiter piston provides communication between the pumping chamber and a lower portion of the testing string when actuated. In the second and third embodiments, a pressure limiter piston is reciprocably disposed in the annulus between the case and mandrel; at a predetermined pressure differential, the pressure limiter piston reciprocates such that the volume in the pumping chamber is increased. A fourth embodiment simply uses a pumping chamber of predetermined volume such that the efficiency of the pump drops to essentially zero when the pressure in the pumping chamber reaches a predetermined level; no pressure limiter piston is used.

20 Claims, 23 Drawing Figures

PRESSURE LIMITER FOR A DOWNHOLE PUMP AND TESTING APPARATUS

BACKGROUND OF THE INVENTION

1. Field of the Invention

This invention relates to downhole testing apparatus having pumps with pressure limiters for pumping fluid to inflate inflatable packers, and more particularly, to a pressure limiter in which fluid pressure in the tool is not vented to the well annulus during an actuation cycle.

2. Description of the Prior Art

A known method of testing a well formation is to isolate the formation between a pair of inflatable packers with a flow port therebetween adjacent the formation. The packers are inflated by means of a pump in the testing string which pumps well annulus fluid or mud into the packers to place them in sealing engagement with the well bore.

Typically, positive displacement pumps are used. One such downhole pump is actuated by the vertical reciprocation of the tubing string connected to the pump, such as disclosed in U.S. Pat. No. 3,876,000 to Nutter and U.S. Pat. No. 3,876,003 to Kisling, III.

Other pumps are actuated by rotation of the tool string. U.S. Pat. No. 3,439,740 to Conover and U.S. Pat. No. 4,246,964 to Brandell, both of which are assigned to the assignee of the present invention, disclose a rotationally operated pump having a plurality of vertically reciprocating pistons which are driven by a cam structure. Inlet and outlet valves are positioned adjacent each of the pistons.

A simpler, sleeve-type pump piston is used in the downhole pump of Evans et al., U.S. Pat. No. 3,926,254, assigned to the assignee of the present invention. In the Evans et al. apparatus, as well as the other pumps described above, the pump piston is in direct contact with the well annulus fluid.

The downhole pump described herein for use with the pressure limiter of the present invention includes a single sleeve-type pump piston, but further includes a diaphragm which separates a piston chamber in which the piston reciprocates from a pumping chamber with inlet and outlet valves therein through which the fluid is moved to inflate the packer. The piston chamber is filled with a clean hydraulic lubricant which promotes longer life for the pump parts. Backup piston wiper rings are provided to clean the piston of abrasive particulate in the event the diaphragm is ruptured.

Simple inlet and outlet check valves with resilient annular sealing lips are used, and these valves are not easily clogged or damaged by abrasives in the well fluid. These valves are similar to valves in the Halliburton Omni RS Circulation Valve, assigned to the assignee of the present invention and described in copending Application Ser. No. 797,375.

When inflating the packers, it is essential that the packers not be overinflated and damaged. To accomplish this, most of the pumps of the prior art include relief valves which relieve pressure from the pump to the well annulus. A major problem with such devices is that if the relief valve is stuck in an open position, the pump cannot be used to inflate the packers and complete an operation. A pump without a relief valve is disclosed in U.S. Pat. No. 4,313,495 to Brandell, assigned to the assignee of the present invention. In this pump, a clutch is used which is disengaged when the pump pressure reaches a predetermined level, thus making the pump inoperative.

The pressure limiter of the present invention limits packer pressure internally and does not vent fluid therein directly to the well annulus. In a first embodiment, the pressure limiter vents around the outlet check valve to the packers at the lower end of the testing string.

In a second and third embodiment, a piston reciprocates in the pressure limiter when the packer pressure reaches the desired level. This reciprocating piston increases the pumping chamber volume in response to the displacement of the pump. As with the first embodiment, there is no venting to the well annulus.

In a fourth embodiment, the pressure limiter is not a separate component, but instead is characterized by the pumping chamber being of predetermined size. As the differential pressure across the pump increases, the efficiency gradually decreases. By proper sizing of the pumping chamber, the efficiency becomes essentially zero at the desired pressure. Therefore, further operation of the pump will not further increase the pressure.

While the pressure limiter of the present invention is adapted for use with the diaphragm pump described herein, it should be emphasized that the pressure limiter could be used equally well with any positive displacement pump, and the invention is not intended to be limited to any particular pump configuration.

SUMMARY OF THE INVENTION

The pressure limiter of the present invention forms a part of a testing string having a positive displacement pump used to pump well annulus fluid for inflating packers adjacent a well formation to be treated. Preferably, the pressure limiter forms a part of the pump.

The pressure limiter comprises enclosure means defining a pumping chamber adjacent the pump, inlet valve means for controlling flow of fluid from a well annulus into the pumping chamber, outlet valve means for controlling fluid flow from the pumping chamber to a lower testing string portion which includes the packers, and pressure limiting means in communication with the pumping chamber for increasing the volume of the pumping chamber when a fluid pressure differential between the pumping chamber and the well annulus exceeds a predetermined value. The pressure limiting means is also adapted for preventing venting of the fluid in the pumping chamber to the well annulus, unlike previously known relief valves. The pressure limiting means is, in a fluid flow sense, disposed substantially between the inlet and outlet valve means.

In a first embodiment of the pressure limiter, the enclosure defines a substantially transverse hole therein in communication with the pumping chamber. In this embodiment, the pressure limiting means comprises a pressure limiter piston sealingly closing the hole when in a normal operating position and opening the hole when in an actuated position such that the pumping chamber and the lower testing string portion are in communication, and biasing means for biasing the pressure limiter piston toward the normal operating position. When the pressure limiter piston is in the actuated position, fluid is bypassed around the outlet valve means. When this occurs, pumping action can still take place, although fluid flow and compression will cease.

In a second embodiment of the pressure limiter, the pressure limiting means comprises pressure limiter piston means reciprocably disposed in the enclosure means and having a first portion and a second portion relatively smaller than the first portion, such that an annular area is defined between the first and second portions. The piston means is movable in response to pumping action of the pump such that the volume of the pumping chamber is increased by an amount approximately equal to a displacement of the pump during a pump cycle. The pressure limiting means further comprises first sealing means for sealingly separating the pumping chamber and the well annulus adjacent the first portion of the piston means and second sealing means for sealingly separating the pumping chamber from the well annulus adjacent the second portion of the piston means. Biasing means are preferably provided for biasing the piston means towards a position minimizing the volume of the pumping chamber.

A third embodiment of the pressure limiter is similar to the second embodiment, but the piston means in the third embodiment further includes a third portion relatively smaller than the second portion such that another annular area is defined between the second and third portions which is in communication with the lower testing string portion and thus the packers. In the third embodiment, the second sealing means is further adapted for sealingly separating the well annulus and the lower testing string portion, and the pressure limiting means further comprises third sealing means for sealingly separating the pumping chamber and the lower testing string portion adjacent the third portion of the piston means.

In both the second and third pressure limiter embodiments, the inlet valve means is preferably mounted on the piston means. Also, filtering means is preferably mounted on the piston means for filtering the fluid in the well annulus flowing to the inlet valve means.

A fourth embodiment of the pressure limiter does not utilize a pressure limiter piston in the pumping chamber at all. Instead, the pumping chamber itself is of a predetermined size and provides means for pressure limitation in the following manner. As the differential pressure across the pump increases, the efficiency of the pump correspondingly decreases. By properly sizing the pumping chamber, the efficiency will drop to essentially zero when the pump pressure reaches the desired level. In this way, it will be seen that additional operation of the pump will not further increase the pressure, and therefore pressure limitation is achieved.

Thus, the present invention includes a variable efficiency pump comprising case means with a piston chamber and a pumping chamber therein, pump piston means disposed in the piston chamber, and inlet and outlet check valve means for allowing flow into and out of the pumping chamber in response to movement of the piston. A mandrel means is rotatable in the case means and comprises cam means thereon. Cam follower means on the pump piston means follows the cam means for reciprocating the piston means in response to rotation of the mandrel means. In the pump embodiment shown herein, diaphragm means sealingly positioned between the piston chamber and pumping chamber prevents fluid communication therebetween, while fluid movement in the pumping chamber is responsive to fluid movement in the piston chamber.

An important object of the invention is to provide a pressure limiter in which venting of fluid in the pressure limiter to a well annulus is prevented.

Another object of the present invention is to provide a pressure limiter for use with a positive displacement pump and having pressure limiting means for increasing a volume of a pumping chamber in the pressure limiter when a fluid pressure differential between the pumping chamber and a well annulus exceeds a predetermined value.

An additional object of the invention is to provide a pressure limiter having a piston reciprocably disposed therein, the piston being movable to a position increasing the volume in the pressure limiter when a pressure differential between fluid in the pressure limiter and a well annulus acting on an annular area on the piston exceeds a predetermined level.

A further object of the invention is to provide a pressure limiter for use with a positive displacement pump and having inlet and outlet check valves having resilient valve portions with annular lips thereon sealingly engaging separate surfaces of a pumping chamber in the pressure limiter when the valves are in closed positions.

Additional objects and advantages of the invention will become apparent as the following detailed description of the preferred embodiment is read in conjunction with the drawings which illustrate such preferred embodiment.

DESCRIPTION OF THE PREFERRED EMBODIMENTS

Figure 1A:
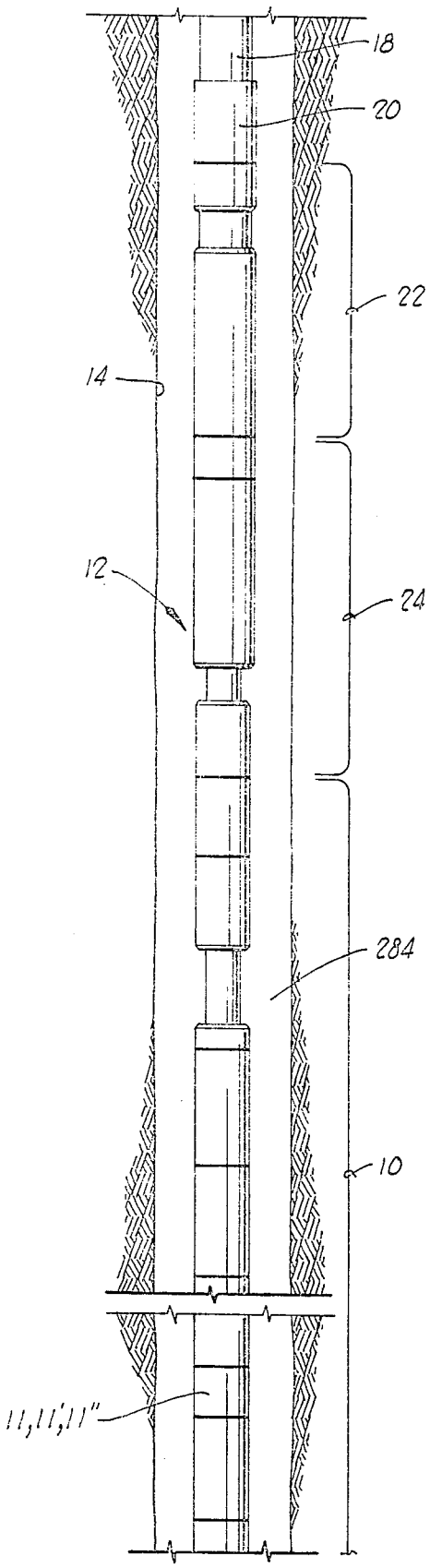
FIGS. 1A–1B show the pressure limiter and testing apparatus of the present invention in position in a well bore for testing a well formation.
Figure 1B:
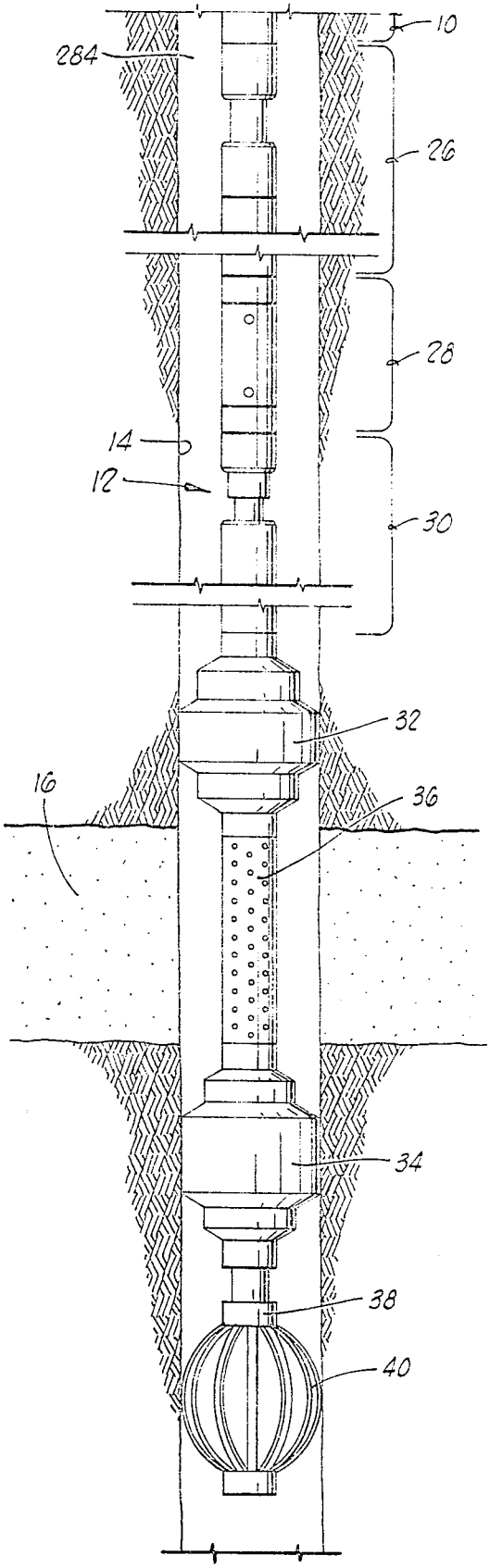

Referring now to the drawings, and more particularly to FIGS. 1A–1B, an inflatable packer pump is shown, generally designated by the numeral 10, including the pressure limiter of the present invention, generally designated by the numeral 11. Pump 10 and pressure limiter 11 form part of a testing string or tool 12. Testing string 12 is shown in position in a well bore 14 for use in testing a well formation 16.

Testing apparatus 12 is attached to the lower end of a tool string 18 and includes a reversing sub 20, a testing valve 22 such as the Halliburton Hydrospring ® tester, and an extension joint 24, all of which are positioned above pump 10.

Disposed below pump 10 in testing apparatus 12 are a packer bypass 26, a string bypass 28, and a safety joint 30 such as the Halliburton Hydroflate® safety joint.

An upper packer 32 is attached to the lower end of safety joint 30 and is disposed above formation 16. A lower packer 34 is positioned below well formation 16. A porting sub 36 interconnects upper packer 32 and lower packer 34. An equalizing tube and spacers (not shown) may also be used between upper packer 32 and lower packer 34 depending upon the longitudinal separation required therebetween.

Upper packer 32 and lower packer 34 are inflatable by pump 10 in a manner hereinafter described such that the packers may be placed in sealing engagement with well bore 14, thus isolating well formation 16 so that a testing operation may be carried out.

A gauge carrier 38 is attached to the lower end of lower packer 34 and includes a plurality of drag springs 40 which are adapted to engage well bore 14 and prevent rotation of a portion of testing apparatus 12 during inflation of upper packer 32 and lower packer 34, as hereinafter described.

Referring now to FIGS. 2A–2F, the details of pump 10 are shown. It should be noted that pressure limiter 11 is not limited to use with this particular pump. Pressure limiter 11 is easily adapted for use with any positive displacement pump. Pump 10 generally includes upper adapter means 42 defining a longitudinally central opening 44 therethrough. Upper adapter means 44 includes a top adapter 46 with an internally threaded upper end 48 adapted for attachment to an upper portion of testing apparatus 12 above pump 10. Forming a lower part of upper adapter means 42 is a torque case 50 attached to a lower end of top adapter 46 at threaded connection 52.

Pump 10 also includes outer case means 54, spaced below upper adapter means 42, which defines a central opening 56 therethrough. An inner, upper mandrel means 58 interconnects upper adapter means 42 and case means 54 and extends into central openings 44 and 56, respectively.

Upper mandrel means 58 includes a torque mandrel 60 having an outer surface 62 slidingly received in bore 64 of top adapter 46, and a seal 66 provides sealing engagement therebetween.

Torque case 50 has an internally splined portion 68 with an inwardly directed annular shoulder 69 at the lower end thereof. Splined portion 68 is engaged with an externally splined portion 70 on torque mandrel 60. It will thus be seen that relative longitudinal movement between upper adapter means 42 and upper mandrel means 58 is possible while relative rotation therebetween is prevented by the mutual engagement of spline portions 68 and 70. Torque case 50 also has a plurality of downwardly directed lugs 71 at the lower end thereof.

The upper end of a floating piston mandrel 72 is threadingly engaged with the lower end of torque mandrel 60 at threaded connection 74. Sealing is provided between floating piston mandrel 72 and torque mandrel 60 by means of a seal 76. Floating piston mandrel 72 extends downwardly out of central opening 44 of upper adapter means 42 and into central opening 56 of case means 54. The upper end of floating piston mandrel 72 has an outer surface 78 in close, sliding relationship with bore 80 of the lower end of torque case 50.

At the upper end of case means 54 is a piston cap 82 attached to a floating piston case 84 at threaded connection 86. Piston cap 82 has a first bore 88 in close spaced relationship with an outer surface 90 of an intermediate portion of floating piston mandrel 72. A seal 92 is provided therebetween. Outwardly spaced from outer surface 90 of floating piston mandrel 72 is a second bore 94 which is in communication with a transverse hole 96 in piston cap 82. Piston cap 82 also has a plurality of upwardly directed lugs 98 at the upper end thereof. Lugs 98 are dimensioned to be engageable with lugs 71 on torque case 50 when desired, as will be discussed in more detail herein.

Figure 2A:
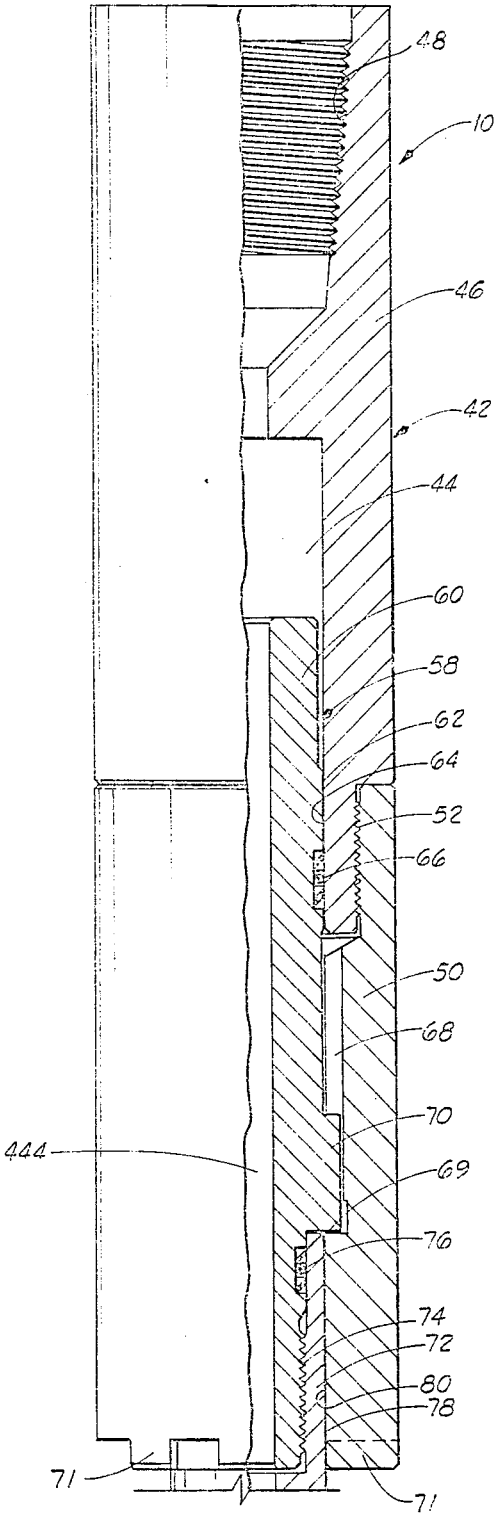
FIGS. 2A–2F show a partial longitudinal cross section of a downhole diaphragm pump with one embodiment of the pressure limiter.
Figure 2B:
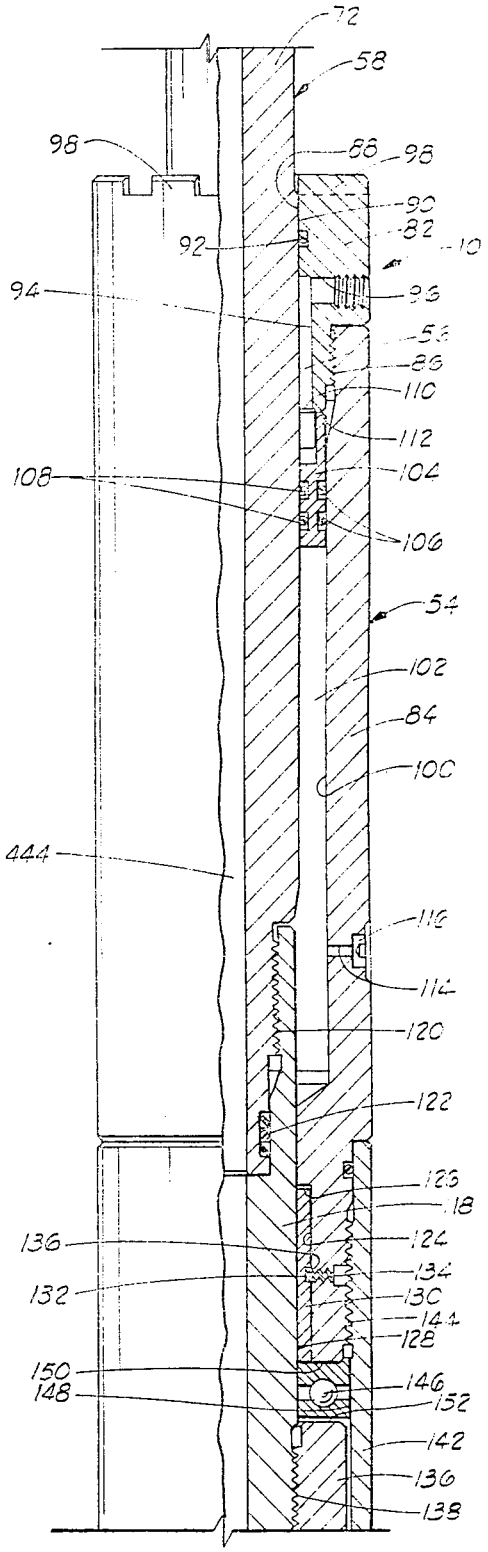

Floating piston case 84 has an inner bore 100 which is outwardly spaced from outer surface 90 of floating piston mandrel 72 such that an annular equalizing chamber 102 is defined therebetween. Reciprocably disposed in equalizing chamber 102 is an annular, floating equalizing piston 104. Piston rings 106 seal between equalizing piston 104 and bore 100 of floating piston case 84, and piston rings 108 seal between the equalizing piston and outer surface 90 of floating piston mandrel 72. As shown in FIG. 2B, an upper end 110 of equalizing piston 104 is engaged with a downwardly facing shoulder 112 on piston cap 82, thus defining an upwardmost position of the equalizing piston. As more fully described hereinafter, equalizing piston 104 is free to reciprocate in equalizing chamber 102 as determined by the differential pressure across the piston.

Floating piston case 84 has a transverse hole 114 therein which is in communication with equalizing chamber 102. Equalizing chamber 102 may be filled with a lubricating oil through transverse hole 114. After filling with oil, hole 114 is closed by plug 116.

The lower end of floating piston mandrel 72 is attached to a bushing mandrel 118 at threaded connection 120. Sealing engagement is provided between floating piston mandrel 72 and bushing mandrel 118 by a seal 22.

The lower end of floating piston case 84 defines a bore 124 with a shoulder 126 at the upper end of the bore. Bore 124 is outwardly spaced from outer surface 128 of bushing mandrel 118 such that a cavity is defined therebetween in which is positioned an annular bushing 130. A set screw 132 is threadingly disposed in a transverse hole 134 in floating piston case 84. Set screw 132 lockingly engages a radially outer groove 136 in bushing 130 for locking the bushing in place with respect to floating piston case 84. Upper mandrel means 58 is adapted for rotation within central cavity 56 of case means 54, and it will be seen by those skilled in the art that bushing 130 provides radial support and alignment for upper mandrel means 58.

Figure 2C:
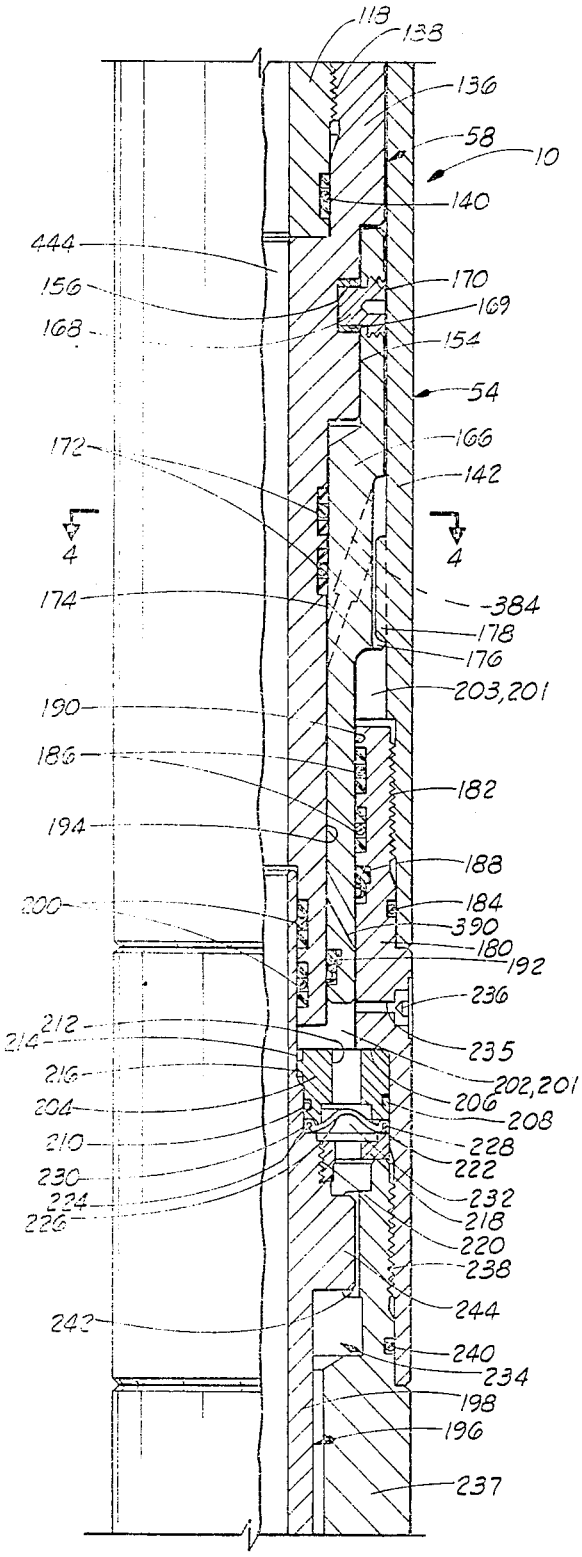

Referring now also to FIG. 2C, the lower end of bushing mandrel 118 is connected to a pump cam 136 at threaded connection 138. A seal 140 is provided for sealing between bushing mandrel 118 and pump cam 136. The lower end of floating piston case 84 is attached to splined piston case 142 at threaded connection 144. It will be seen that splined piston case 142 covers set screw 132.

A thrust bearing 146 is annularly disposed between outer surface 128 of bushing mandrel 118 and bore 148 in splined piston case 142 and longitudinally between a downwardly facing shoulder 150 on floating piston case 84 and an upwardly facing shoulder 152 on pump cam 136. Thrust bearing 146 absorbs longitudinal loading between upper mandrel means 58 and case means 54 while still allowing relative rotation therebetween.

Figure 3:
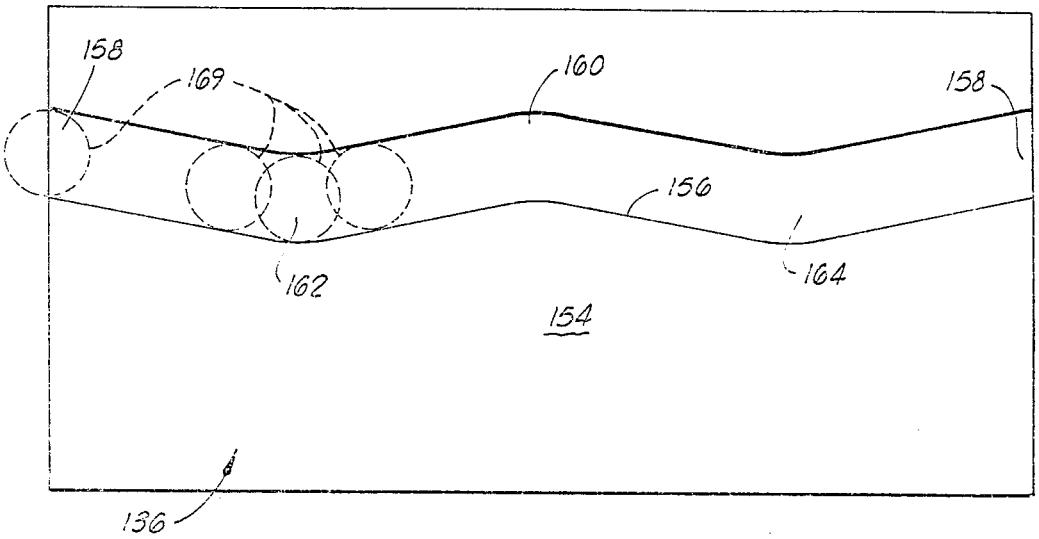
FIG. 3 is a 360° elevation of the pump cam.

Pump cam 136 has an intermediate substantially cylindrical outer surface 154 which defines a substantially annular cam slot 156 therein. In the 360° view of outer surface 154 shown in FIG. 3, it will be seen that cam slot 156 has two upper portions 158 and 160 and two lower portions 162 and 164.

Still referring also to FIG. 2C, annularly disposed between pump cam 136 and splined piston case 142 is a piston means, preferably in the form of a single, sleeve-type pump piston 166. A cam follower pin 168 with a cam roller 169 thereon is transversely positioned on pump piston 166 and affixed thereto at threaded connection 170. Cam follower pin 168 extends radially inwardly into cam slot 156 on pump cam 136. Cam roller 169 fits freely on cam follower pin 168 and is guided by cam slot 156. Cam roller 169 is shown in various positions along cam slot 156 in FIG. 3. Seals 172 provide sealing between pump cam 136 and inner surface 174 of pump piston 166.

The outer surface of pump piston 166 includes a plurality of outer splines 176 which engage inner splines 178 in splined piston case 142. Thus, pump piston 166 is prevented from relative rotation with respect to splined piston case 142, while relative longitudinal movement therebetween is permitted.

The lower end of splined piston case 142 is connected to the upper end of a piston seal case 180 at threaded connection 182. A seal 184 is provided therebetween.

A pair of seals 186 and a wiper ring 188 are provided between piston seal case 180 and outer surface 190 of pump piston 166. Another wiper ring 192 is located between the inside of pump piston 166 and outer surface 194 of pump cam 136. Seals 186 provide a sealing means between pump piston 166 and piston seal case 166. Wiper rings 188 and 192 act as a backup for cleaning pump piston 166 of mud abrasives in tthe event of failure of diaphragm 226 hereinafter described. The primary function of wiper rings 188 and 192 is to clean, although some sealing action may also occur.

Positioned within case means 54 and below inner, upper mandrel means 58 is an inner, lower mandrel means 196. Forming an upper end of lower mandrel means 196 is a diaphragm mandrel 198. The upper end of diaphragm mandrel 198 is received within the lower end of pump cam 136, and seals 200 are provided therebetween. As will be hereinafter described, upper mandrel means 58 is rotatable with respect to lower mandrel means 196, and thus pump cam 136 is rotatable with respect to diaphragm mandrel 198.

A substantially annular piston chamber 202 is generally defined between pump cam 136 of upper mandrel means 58 and splined piston case 142 and piston seal case 180 of case means 54. Piston chamber 201 includes a lower portion 202 and an upper portion 203. As will be hereinafter described, pump piston 166 will longitudinally reciprocate within piston chamber 201 as upper mandrel means 58, and therefore pump cam 136, are rotated. As shown in FIG. 2C, pump piston 166 is at the uppermost point in its stroke in piston chamber 201.

At the lower end of piston chamber 201 and annularly positioned between diaphragm mandrel 198 and piston seal case 180 is a diaphragm clamp 204. The upper end of diaphragm clamp 204 is in contact with annular shoulder 206 in piston seal case 180. An outer seal 208 is positioned between diaphragm clamp 204 and piston seal case 180, and an inner seal 210 is positioned between diaphragm clamp 204 and diaphragm mandrel 198. Diaphragm clamp 204 defines a plurality of longitudinally disposed holes 212 therethrough which form part of lower portion 202 of piston chamber 201.

A plurality of outer splines 214 on piston mandrel 198 are engaged by a plurality of inner splines 216 on the inside of diaphragm clamp 204. Thus, relative rotation between diaphragm clamp 204 and diaphragm mandrel 198 is prevented.

A diaphragm limiter 218 is connected to diaphragm mandrel 198 at threaded connection 220. Diaphragm limiter 218 is positioned below, and spaced from, diaphragm clamp 204.

Diaphragm limiter 218 has an annular, upper shoulder 220, and diaphragm mandrel 198 has an annular, upper shoulder 224 thereon spaced radially inwardly from shoulder 222 on the diaphragm limiter. Shoulders 222 and 224 are preferably substantially aligned longitudinally, but some misalignment is acceptable.

An annular diaphragm 226 is longitudinally positioned between diaphragm clamp 204 and diaphragm limiter 218. Diaphragm 226 has a beaded outer edge 228 which is sealingly clamped between diaphragm clamp 204 and shoulder 222 on diaphragm limiter 218. Similarly, diaphragm 226 has a beaded inner edge 230 which is sealingly clamped between diaphragm clamp 204 and shoulder 224 on diaphragm mandrel 198. Thus, cavity 232 below diaphragm 226 is sealingly separated from piston chamber 202. Diaphragm 226 is preferably formed from a reinforced elastomeric material. Cavity 232 forms an upper portion of a pumping chamber, generally designated by the numeral 234.

A transverse hole 235 through piston seal case 180 opens into lower portion 202 of piston chamber 201. Piston chamber 201 may be filled with a lubricating oil through transverse hole 235. After filling, hole 235 is closed with plug 236. A study of FIGS. 2B and 2C will show that upper portion 203 of piston chamber 201 is in communication with equalizing chamber 102. Thus, the entire annular volume below equalizing piston 104 and above diaphragm 226 is filled with oil.

A lower end of piston seal case 180 is connected to an upper end of a splined upper pump breakoff 237 at threaded connection 238. Upper pump breakoff 237 thus forms another portion of case means 54. A seal 240 is provided between piston seal case 180 and upper pump breakoff 237.

Upper pump breakoff 237 has a plurality of inwardly directed splines 242 which are engaged by outwardly directed splines 244 on diaphragm mandrel 196. Thus, relative rotation between diaphragm mandrel 196 and case means 54 is prevented. It will be seen that this prevents relative rotation between lower mandrel means 196 and case means 54.

Figure 2D:
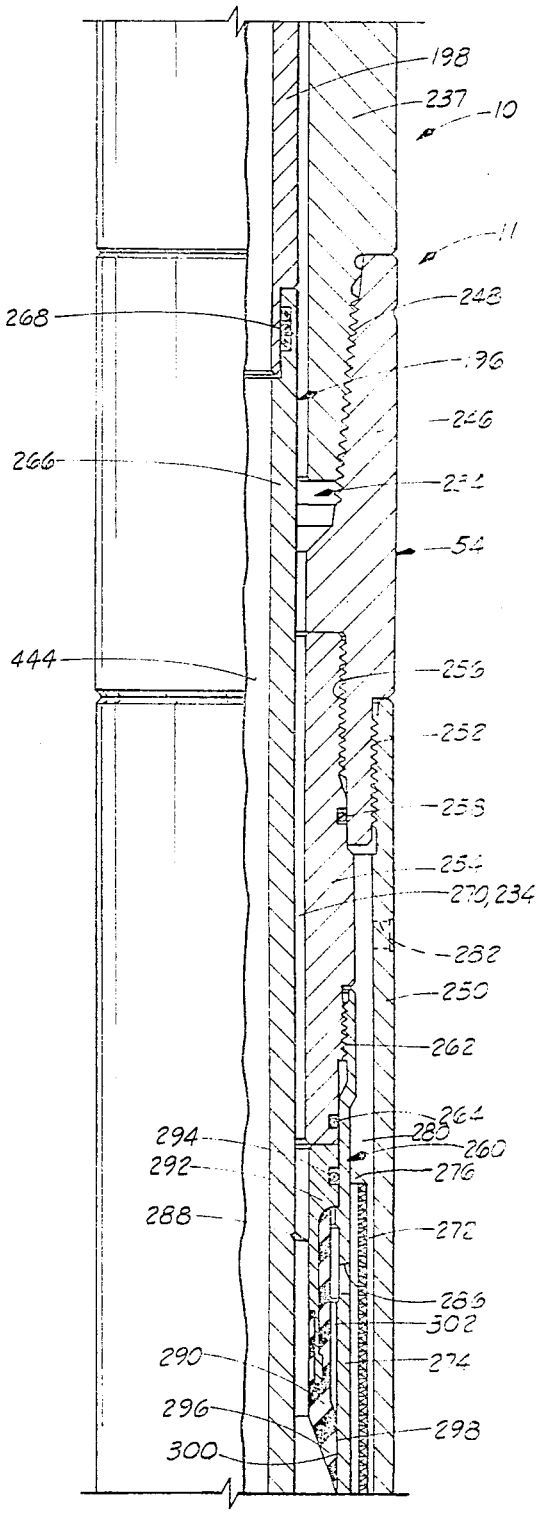

Referring now to FIG. 2D, the upper portion of a first embodiment of pressure limiter 11 with additional components of case means 54 and lower mandrel means 196 are shown. Upper pump breakoff 237 is connected to bottom pump breakoff 246 at threaded connection 248. An upper end of a pressure limiter case 250 is connected to an outer portion of the lower end of bottom pump breakoff 246 at threaded connection 252. The upper end of a check valve holder 254 is connected to an inner portion of the lower end of bottom pump breakoff 246 at threaded connection 256. A seal 258 is disposed between bottom pump breakoff 246 and check valve holder 254.

The upper end of an intake screen assembly 260 is attached to the lower end of check valve holder 254 at threaded connection 262. A seal 264 is disposed between intake screen assembly 260 and check valve holder 254.

A lower end of diaphragm mandrel 198 is received in an upper end of pump mandrel 266. A seal 268 provides sealing engagement between diaphragm mandrel 198 and pump mandrel 266. An annular cavity 270 is thus defined between pump mandrel 266 and check valve holder 254. It will be seen that cavity 270 is in communication with cavity 232 and thus forms a portion of pumping chamber 234.

Figure 2E:
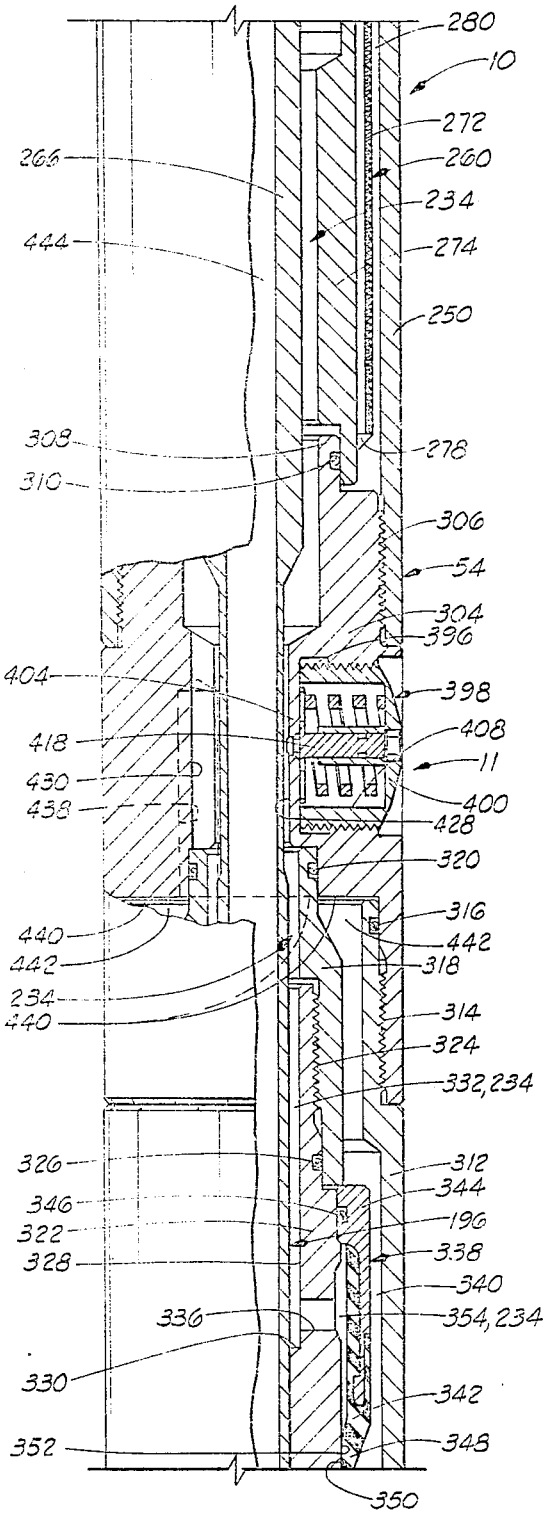

Referring now also to FIG. 2E, it will be seen that intake screen 260 includes an intake screen 272 annularly disposed around, and spaced radially outwardly from, a screen mandrel 274. Intake screen 272 is fixedly attached to screen mandrel 274 such as by upper weld 276 and lower weld 278.

Intake screen assembly 260 is spaced radially inwardly from pressure limiter case 250 such that an annular inlet chamber 280 is defined therebetween. Pressure limiter case 250 defines at least one transverse hole 282 therethrough which provides communication between inlet chamber 280 and well annulus 284 defined between well bore 14 and testing string 12. Well annulus 284 is shown in FIGS. 1A and 1B. Screen mandrel 274 defines at least one transverse hole 286 therethrough and located inside intake screen 272. It will be seen that hole 286 is in communication with well annulus fluid passing through intake screen 272.

As shown in FIG. 2D, inlet check valve means, generally designated by the numeral 288, is provided for allowing well annulus fluid passing through hole 286 to enter pumping chamber 234 when desired, in a manner hereinafter described. Inlet check valve means 288 preferably comprises a resilient valve portion 290 carried by a valve portion carrier 292. Valve portion 290 and valve portion carrier 292 are annularly disposed between intake screen assembly 260 and pump mandrel 266 and longitudinally immediately below check valve holder 254. A seal 294 is provided between valve portion carrier 292 and sleeve mandrel 274 of screen assembly 260. Valve portion 290 has a resilient annular lip 296 having a radially outer surface 298 that is sealingly engaged against radially inner surface 300 of screen mandrel 274. Valve portion 290 is further configured such that an annular space 302 is defined between valve portion 290 and screen mandrel 274. It will be seen that annular space 302 is in communication with hole 286 in screen mandrel 274 and thus in communication with fluid in well annulus 284.

Referring again to FIG. 2E, the lower end of pressure limiter case 250 is connected to a pressure limiter body 304 at threaded connection 306. Pressure limiter body 304 is a major component of the first embodiment of pressure limiter means 11, as will be discussed in more detail hereinafter. An upper portion 308 of pressure limiter body 304 extends into the lower end of screen mandrel 274 of intake screen assembly 260. A seal 310 is positioned therebetween.

The lower end of pressure limiter body 304 is connected to a lower check valve case 312 at threaded connection 314, and a seal 316 provides sealing engagement therrebetween. It will be seen that pressure limiter body 304 and lower check valve case 312 are additional components of case means 54.

Pump mandrel 266 extends longitudinally through pressure limiter body 304 and lower check valve case 312, thus defining additional portions of pumping chamber 234 between pump mandrel 266 and case means 54. Adjacent pressure limiter body 304 and spaced radially outwardly from pump mandrel 266 is a substantially annular check valve retainer 318. A seal 320 is provided between check valve retainer 318 and an intermediate portion of pressure limiter body 304. A lower end of check valve retainer 318 is attached to a check valve seat 322 at threaded connection 324, and a seal 326 is provided therebetween. Check valve seat 322 has an inner bore 328 with an annular shoulder 330 extending radially inwardly therefrom. It will be seen that a cavity 332 is defined between bore 328 of check valve seat 322 and pump mandrel 266. Cavity 332 forms a lowermost part of pumping chamber 234.

Figure 2F:
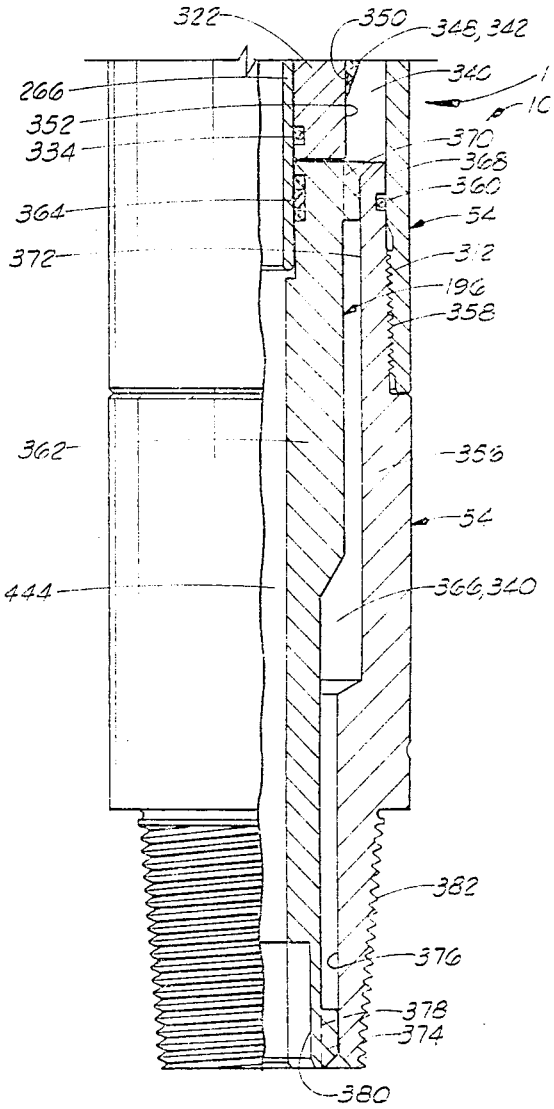

Referring now also to FIG. 2F, a seal 334 is provided between check valve seat 322 and pump mandrel 266 below shoulder 330. Check valve seat 322 defines at least one transverse hole 336 therethrough which is in communication with cavity 332.

Outlet check valve means, generally designated by the numeral 338, is provided for controlling flow of fluid out of pumping chamber 234 into annular outlet chamber 340 defined between case means 54 and lower mandrel means 196. Outlet check valve means 338 preferably includes a resilient annular valve portion 342 carried by valve portion carrier 344. valve portion carrier 344 is disposed longitudinally below check valve retainer 318 and annularly between check valve seat 322 and lower chack valve case 312. A seal 346 is provided between valve portion carrier 344 and check valve seat 322. Valve portion 342 includes a resilient annular lip 348 having a radially inner surface 350 which sealingly engages a radially outer surface 352 of check valve seat 322. Valve portion 342 and check valve seat 322 are adapted to define an annular space 354 in fluid communication with hole 336, and thus also forming a portion of pumping chamber 234.

Referring again to FIG. 2F, the lower end of lower check valve case 312 is connected to a lower adapter 356 at threaded connection 358, and a seal 360 is provided therebetween. It will be seen that lower adapter 356 thus forms the lowermost portion of case means 54.

A lower end of pump mandrel 266 is received in an upper end of an adapter mandrel 362. A seal 364 is provided for sealing engagement between pump mandrel 266 and adapter mandrel 362. Adapter mandrel 362 and lower adapter 356 define an annular cavity 366 therebetween. Extending radially outwardly from the upper end of adapter mandrel 362 are a plurality of upper guide lugs 368 which are angularly disposed from one another such that gaps 370 are defined therebetween. Upper guide lugs 368 are in close spaced relationship to first inner bore 372 of lower adapter 356 and guide thereon. At the lower end of adapter mandrel 362 are a plurality of lower guide lugs 374 which are in close spaced relationship to second inner bore 376 of lower adapter 56, and thus guide thereon. Lower guide lugs 374 are angularly displaced from one another such that a plurality of gaps 378 are defined therebetween. It will be seen that because of gaps 370, annular cavity 366 forms a portion of discharge chamber 340.

The lower end of adapter mandrel 362 defines an inner bore 380 and the lower end of lower adapter 356 has an externally threaded portion 382 which are adapted for engagement with the portion of testing apparatus 12 positioned below pump 10 and pressure limiter 11, in a manner known in the art. This lower portion of testing apparatus 12 has an annular passageway therethrough (not shown) in fluid communication with upper packer 32 and lower packer 34. Because of gaps 378, it will be seen that this annular passageway is in fluid communication with discharge chamber 340.

Figure 4:
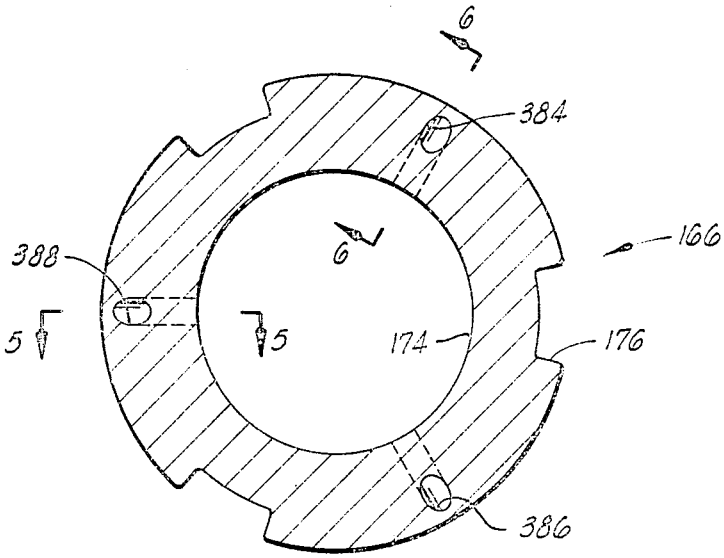
FIG. 4 is a cross-sectional view of the pump piston taken along lines 4—4 in FIG. 2C.

Referring not to FIG. 4, a transverse cross section through the portion of pump piston 166 which includes splines 176 is shown. Three angularly disposed passageways 384, 386 and 388 extend through pump piston 166. As shown in FIG. 2C, passageway 384 opens into inner surface 174 of pump piston 166 at a point below seals 172, even when the pump piston is at the uppermost position. The other end of passageway 384 opens into upper portion 203 of piston chamber 201 adjacent splines 176. Passageways 386 and 388 are similarly located.

Extending angularly through a lower end of pump piston 160 are a plurality of bypass ports 390. In the preferred embodiment, four such ports are used. However, it is not intended that the invention be limited to this number. Each port 390 opens into inner surface 174 of pump piston 166 at a point above wiper ring 192. The other end of each bypass port 390 opens into outer surface 190 of pump piston 166, and thus into lower portion 202 of piston chamber 201, at a point below wiper ring 188, even when the pump piston is at the topmost position shown in FIG. 2C.

It will thus be seen that a fluid path is defined through bypass ports 390, annularly between pump piston 166 and pump cam 136, and through passageways 384, 386 and 388 which provides intercommunication between lower portion 202 and upper portion 203 of piston chamber 201.

Figure 5:
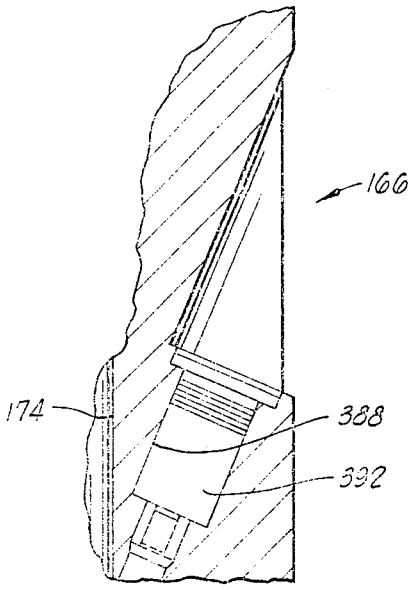
FIG. 5 is a cross section taken along lines 5—5 in FIG. 4 and showing a visco-jet.
Figure 6:
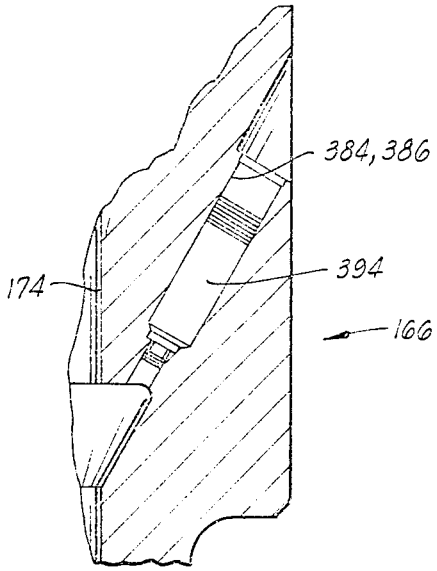
FIG. 6 is a cross-sectional view of the pump piston taken along lines 6—6 in FIG. 4 and showing a one-way check valve.

Obviously, if passageways 384, 386 and 388 were always open, reciprocation of pump piston 166 would have no pumping effect. Therefore, flow control means are provided in passageways 384, 386 and 388 for controlling fluid flow through this fluid path. Referring now to FIGS. 5 and 6, the flow control means includes a visco-jet 392 disposed in passageway 388 and a one-way check valve 394 disposed in each of passageways 384 and 386.

Visco-jet 392 is a highly restricted orifice of a kind known in the art which allows very retarded fluid movement upwardly through passageway 388. Any fluid flow through visco-jet 392 is so small over a short period of time as to have a negligible effect upon the efficiency of pump 10 when pump piston 166 is reciprocating during normal pumping. Check valves 394 are also a kind known in the art and allow fluid flow downwardly through passageways 384 and 386 while preventing upward fluid flow therethrough. The significance of visco-jet 392 and check valves 394 on the operation of pump 10 will be more fully explained in the discussion of the operation of the invention herein.

Referring again to FIG. 2E in which the first embodiment of pressure limiter 11 is shown, pressure limiter body 304 has a transverse cavity 396 in which is disposed a pressure limiter assembly 398.

Figure 7:
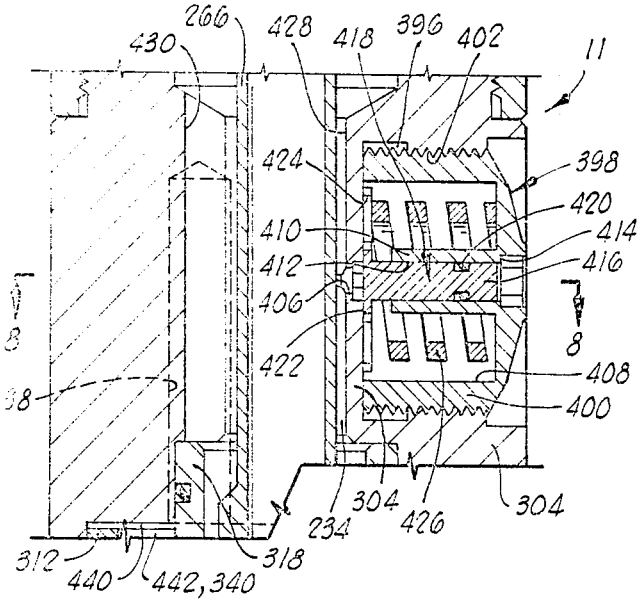
FIG. 7 is an enlarged area of a portion of FIG. 2E showing the first embodiment of the pressure limiter.

Referring now also to the enlarged detail of FIG. 7, pressure limiter assembly 398 includes a pressure limiter housing 400 which is fixed in transverse cavity 396 by threaded connection 402. Pressure limiter housing 400 engages seat portion 404 of pressure limiter body 304. Seat portion 404, which defines a radially inner boundary of transverse cavity 396 defines a transverse hole 406 therethrough in communication with pumping chamber 234. Hole 406 opens into a central cavity 408.

From the outermost end of pressure limiter housing 400 a sleeve 410 extends radially inwardly into central cavity 408. Sleeve 410 defines a substantially cylindrical piston bore 412 therethrough with an inwardly extending shoulder 414 adjacent the outer end of the piston bore. Reciprocably disposed in piston bore 412 is a substantially cylindrical portion 416 of a pressure limiter piston 418. Cylindrical portion 416 of pressure limiter piston 418 slides within piston bore 418, and a seal 420 is provided therebetween.

Extending outwardly from cylindrical portion 416 of pressure limiter piston 418 is a flange portion 422 which defines a plurality of openings 424 therethrough. When pressure limiter piston 418 is in the closed position shown in FIGS. 2E and 7, flange portion 422 is in sealing engagement with seat portion 404 of pressure limiter body 304 such that hole 406 is closed. A spring 426 biases pressure limiter piston 418 to the closed position.

Figure 9:
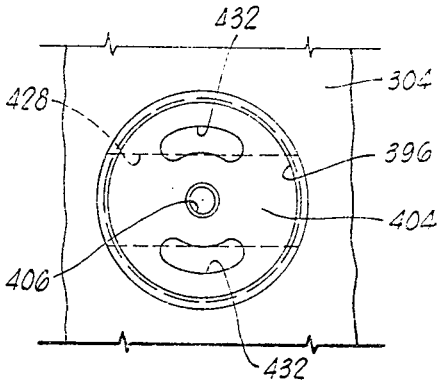
FIG. 9 is an elevation of the first embodiment pressure limiter body as viewed from lines 9—9 in FIG. 8.
Figure 8:
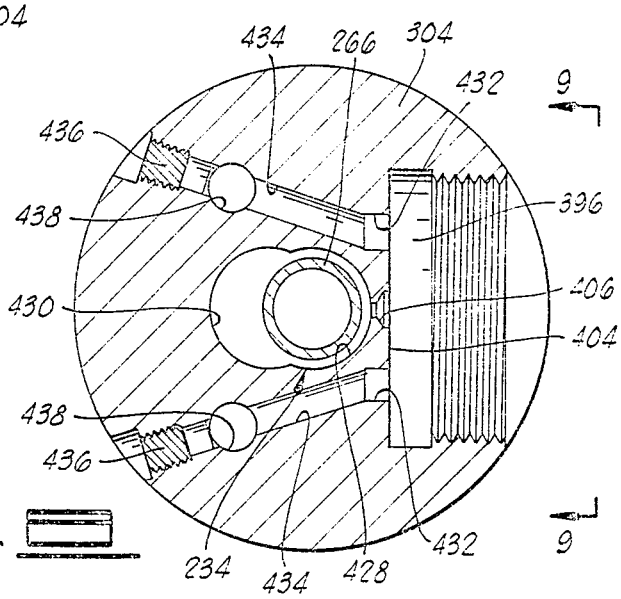
FIG. 8 is a cross section of the first embodiment pressure limiter body taken along lines 8—8 in FIG. 7.

Referring now also to FIGS. 8 and 9, a bypass passageway system through pressure limiter body 304 is shown. In FIGS. 8 and 9, pressure limiter housing 400, pressure limiter piston 418 and spring 426 are removed for clarity. As already discussed, hole 406 through seat portion 404 of pressure limiter body 304 is in communication with pumping chamber 234, a portion of which is defined by the annulus between central bore 428 in pressure limiter body 304 and pump mandrel 266. An offset bore 430 is provided longitudinally in pressure limiter body 304 adjacent central bore 428 to insure a sufficiently large cross-sectional area of pumping chamber 234 at the longitudinal area adjacent pressure limiter assembly 398.

A pair of curvilinear slots 432, best shown in FIG. 9, are defined in seat portion 404 of pressure limiter body 304. Each of slots 432 is in communication with a substantially transversely oriented hole 434 extending angularly therefrom. A plug 436 closes off the outer end of each hole 434 and thus prevents communication between holes 434 and well annulus 284. Openings 424 in pressure limiter piston 418 and slots 432 in pressure limiter body 304 are adapted to be at least partially aligned at all times so that constant fluid communication is provided between holes 434 and central cavity 408 of pressure limiter housing 400.

Intersecting each transverse hole 434 is a longitudinally oriented hole 438 which extends upwardly from shoulder 440 in pressure limiter body 304. Holes 434 are shown in hidden lines in FIGS. 2E and 7. Holes 438 open into an upper portion 442 of outlet chamber 340. Thus, it will be seen that central cavity 408 of pressure limiter housing 400 is in fluid communication with outlet chamber 340. Further, when pressure limiter piston 418 is moved radially outwardly from seat portion 404 of pressure limiter body 304, pumping chamber 234 is also in fluid communication with outlet chamber 340, and thus outlet check valve means 338 is bypassed, as more fully described herein.

Referring now to FIGS. 10A through 10D, a second pressure limiter embodiment is shown and generally designated by the numeral 11'. Pressure limiter 11' forms a lower portion of a pump which is identical to pump 10 from diaphragm 266 up. Only the portion of the pump adjacent diaphragm 226 is shown in FIGS. 10A through 10D, including case means 54' and inner lower mandrel means 196' which form an enclosure means in pressure limiter 11'. Case means 54' and mandrel means 196' generally define an annulus 445 therebetween.

Case means 54' includes an upper pressure limiter case 446 attached to piston seal case 180 at threaded connection 448. A seal 450 is provided therebetween.

Upper pressure limiter case 446 defines a first bore 452, a second bore 454 and an annular recess 456 between the first and second bores. Annular recess 456 has a larger diameter than second bore 454. A pressure limiter case 458 is attached to the lower end of upper pressure limiter case 446 at threaded connection 460. Referring also to FIG. 10B, pressure limiter case 458 defines at least one transverse hole 462 therethrough.

In pressure limiter 11', diaphragm limiter 218 is connected to diaphragm mandrel 464 at threaded connection 466. Diaphragm mandrel 464 has a plurality of outer splines 468 which are engaged with inner splines 216 on diaphragm clamp 204 so that relative rotation therebetween is prevented.

Mandrel means 196' includes a pressure limiter mandrel 470 attached to diaphragm mandrel 464 at threaded connection 472. A seal 474 is provided between diaphragm mandrel 464 and pressure limiter mandrel 470.

A pressure limiter piston means 475 is reciprocably disposed in annulus 445 between case means 54' and mandrel means 196'. Piston means 475 includes a piston body 476 with an upper cylindrical end 477 in close relationship to second bore 454 of upper pressure limiter case 446. A seal 480 insures sealing engagement between upper end 477 of pressure limiter piston body 476 and upper pressure limiter case 446. An upper wiper ring 482 and a lower wiper ring 484 are provided for wiping piston body 476 clean of abrasives. Pressure limiter piston body 476 defines a transverse hole 486 therethrough.

Figure 10A:
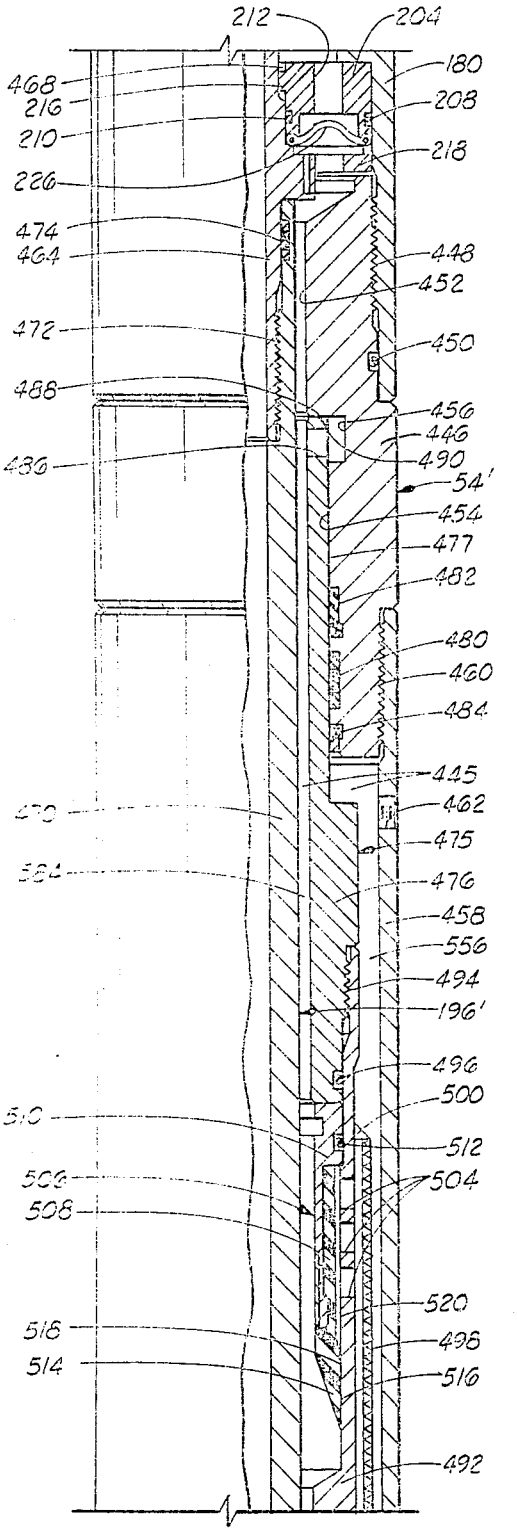
FIGS. 10A–10D show a portion of the downhole diaphragm pump below the diaphragm which includes a second embodiment of the pressure limiter.
Figure 10B:
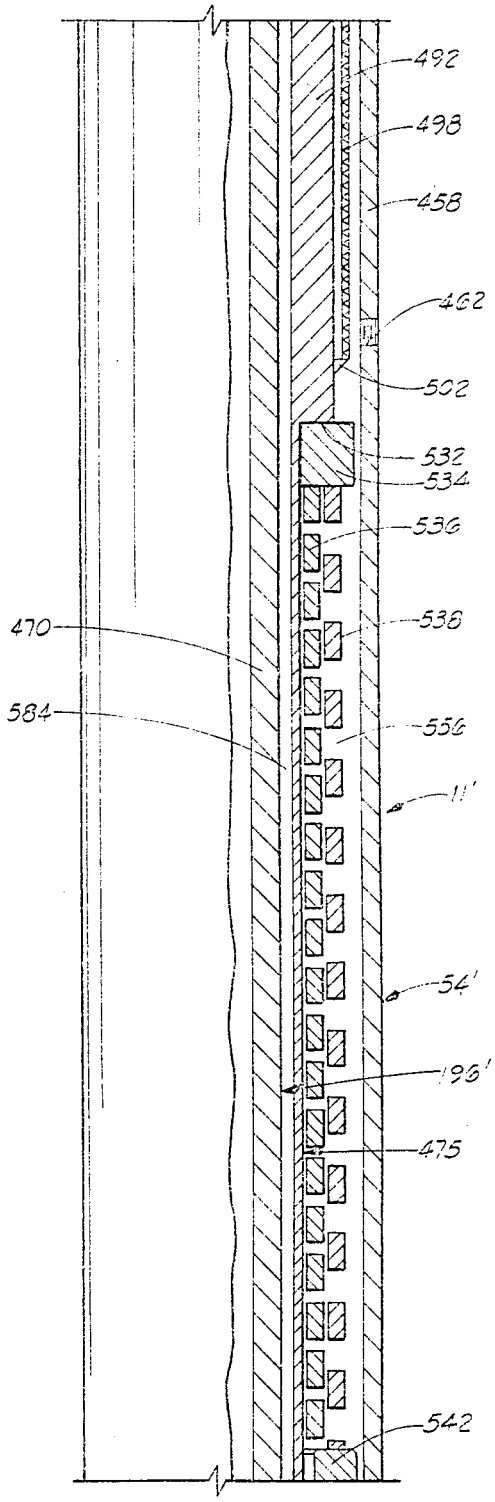

When piston means 475 is in the uppermost position shown in FIG. 10A, upper face 488 of pressure limiter piston body 476 is engaged with shoulder 490 in upper pressure limiter case 446, and hole 486 is substantially aligned with recess 456.

The lower end of pressure limiter piston body 476 is attached to pressure limiter piston sleeve 492 at threaded connection 494. A seal 496 is provided therebetween. It will be seen that pressure limiter piston sleeve 492 provides an intake screen mandrel for an intake screen 498 attached thereto at welds 500 and 502. Intake screen 498 is disposed annularly around pressure limiter piston sleeve 492 and spaced radially outwardly therefrom. Adjacent the upper end of intake screen 498, pressure limiter piston sleeve 492 defines a plurality of transverse holes 504 therethrough.

Inlet check valve means, generally designated by the numeral 506, is provided for controlling flowing fluid through holes 504. Inlet check valve means 506 is substantially similar to inlet check valve means 288 in the first embodiment, and comprises a resilient valve portion 508 carried by a valve portion carrier 510. Valve portion 508 and valve portion carrier 510 are annularly disposed between pressure limiter piston sleeve 492 and pressure limiter mandrel 470 and longitudinally immediately below pressure limiter piston body 476. A seal 512 is provided between valve portion carrier 510 and pressure limiter piston sleeve 492. Valve portion 508 has resilient annular lip 514 having a radially outer surface 516 sealingly engaged against radially inner surface 518 of pressure limiter piston sleeve 492. Valve portion 508 is further configured such that an annular space 520 is defined between valve portion 508 and pressure limiter piston sleeve 492. It will be seen that annular space 520 is in communication with holes 504.

Inlet check valve means 506 is thus preferably mounted on piston means 475 for providing a more compact apparatus. However, inlet check valve means could be mounted elsewhere between case means 54' and mandrel means 196'.

Figure 10C:
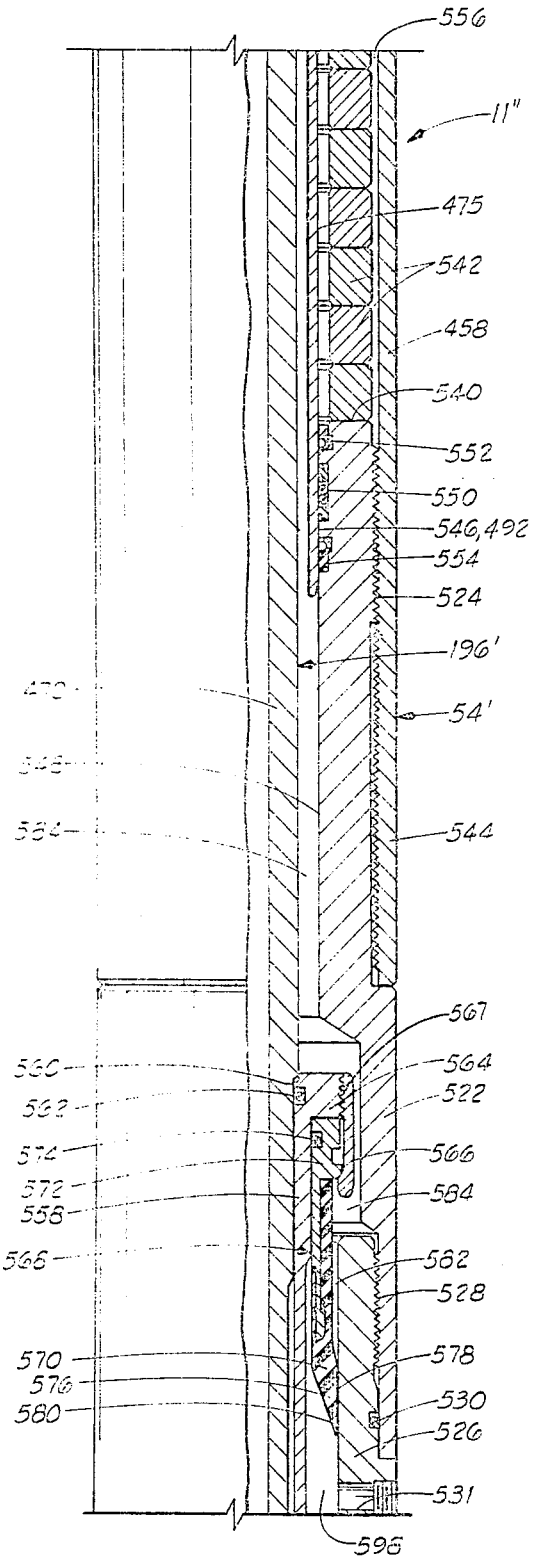

Referring now to FIG. 10C, the lower end of pressure limiter case 458 is attached to the upper end of a lower pressure limiter case 522 of case means 54' at threaded connection 524. The lower end of lower pressure limiter case 522 is connected to check valve case 526 at threaded connection 528, and a seal 530 is provided therebetween. Check valve case 526 defines a transverse exhaust test port 531 therethrough. Port 531 is plugged during normal operation.

Referring now to FIGS. 10B and 10C, pressure limiter piston sleeve 492 defines a downwardly facing shoulder 532. An annular, ring-like spring seat 534 is positioned adjacent shoulder 532 and biased thereagainst by inner pressure limiter spring 536 and outer pressure limiter spring 538.

Lower pressure limiter case 522 has a shoulder 540 thereon, generally facing upwardly toward shoulder 532 on pressure limiter piston sleeve 492. Positioned between shoulder 540 and the lower ends of inner pressure limiter spring 536 and outer pressure limiter spring 538 are a plurality of spring spacers 542. The number of spring spacers 542 may vary for adjusting the preload provided by inner pressure limiter spring 536 and outer pressure limiter spring 538 on piston means 475.

It will be seen that threaded lower end 544 of pressure limiter case 458 is longer than is necessary to merely provide threaded connection 524. This extra length allows easier assembly of pressure limiter case 458 with lower pressure limiter case 522 without the necessity of precompressing inner pressure limiter spring 536 and outer pressure limiter spring 538.

A lower cylindrical end 546 of pressure limiter piston sleeve 542 is in close relationship with bore 548 of lower pressure limiter case 522. A seal 550 provides sealing engagement between lower end 546 of pressure limiter piston sleeve 492 and lower pressure limiter case 522. An upper wiper ring 552 and a lower wiper ring 554 are provided for wiping piston sleeve 492 clean of abrasives.

Upper end 477 of piston body 476 and lower end 546 of pressure limiter piston sleeve 492 may be characterized as first cylindrical portion 477 and second cylindrical portion 546, respectively, of piston means 475.

It will thus be seen that a substantially annular inlet chamber 556 is sealingly defined between piston means 475 and case means 54'. Communication is provided between inlet chamber 556 and well annulus 284 by holes 462.

At a position below piston means 475, a check valve holder 558 is annularly positioned around pressure limiter mandrel 470 and longitudinally located at shoulder 560 thereon. A seal 562 is provided therebetween. Check valve holder 558 has a radially outwardly extending flange 564 at the upper end thereof. A sleeve 566 is attached to flange 564 at threaded connection 567 and extends downwardly therefrom.

Disposed below flange 564 is an outlet check valve means, generally designated by the numeral 568. Outlet check valve means 568 preferably comprises a resilient valve portion 570 carried by a valve portion carrier 572. Valve portion 570 and valve portion carried 572 are annularly positioned around check valve holder 558. Valve portion carrier 572 is adapted to be held in place by sleeve 566. A seal 574 provides sealing engagement between valve portion carrier 572 and check valve holder 558. Valve portion 570 has a resilient annular lip 576 having a radially outer surface 578 that is sealingly engaged against a radial surface 580 of check valve case 526. Valve portion 570 is further configured such that an annular space 582 is defined between valve portion 570 and check valve holder 558 above annular lip 576.

In the preferred second embodiment, outlet check valve means 568 is subtantially identical to inlet check valve means 506. In other words, valve portions 508 and 570 are substantially identical, and valve carrier portions 510 and 572 are also substantially identical.

Referring to FIGS. 10A through 10C, it will thus be seen that a generally annular pumping chamber 584 is defined on the inside by pressure limiter mandrel 470 of mandrel means 196' and on the outside by case means 54' and piston means 475. Pumping chamber 584 is bounded longitudinally by diaphragm 226 at the upper end thereof and outlet check valve means 568 at the lower end thereof. Annular space 582 forms a lowermost portion of pumping chamber 584.

Figure 10D:
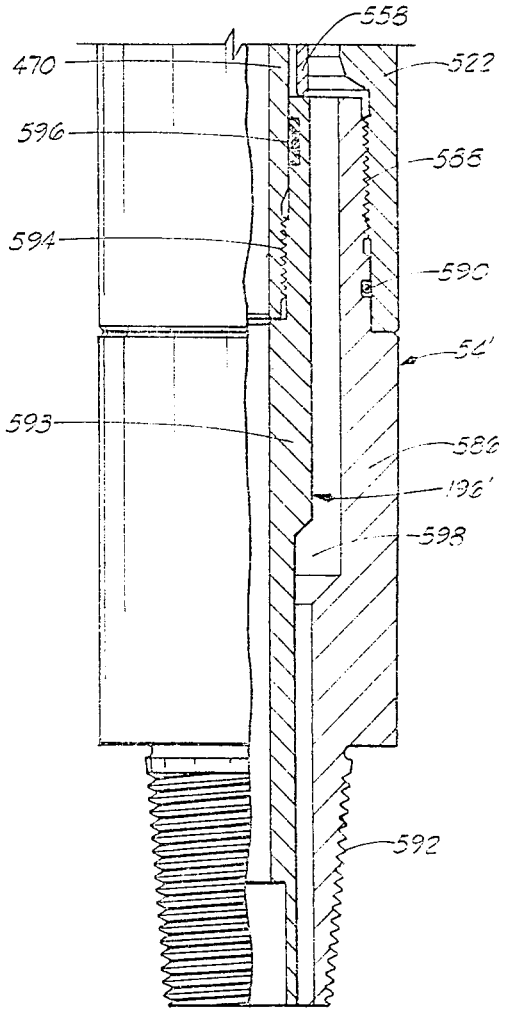

Referring now to FIG. 10D, the lower end of lower pressure limiter case 522 is attached to lower adapter 586 and threaded connection 588. Lower adapter 586 thus forms the lower end of case means 54'. A seal 590 is provided between lower pressure limiter case 522 and lower adapter 586. Lower adapter 586 has a threaded lower portion 592 which is adapted for connection to the lower portion of testing string 12 in a manner known in the art.

The lower end of pressure limiter mandrel 570 is connected to the upper end of adapter mandrel 593 at threaded connection 594, and a seal 596 provides sealing engagement therebetween. The lower end of adapter mandrel 593 is adapted for attachment to the lower portion of testing string 12 in a manner known in the art.

Referring again to FIG. 10C, an outlet chamber 598 is annularly defined between case means 54' and mandrel means 196' below outlet check valve means 568. Outlet chamber 598 is in communication with the lower portion of testing string 12 including upper packer 32 and lower packer 34.

Referring now to FIGS. 11A through 11D, a third embodiment of the pressure limiter is shown and generally designated by the numeral 11". As with the second embodiment, the portion of the pump above diaphragm 226 is substantially identical to pump 10 in the first embodiment. The area around diaphragm 226 is repeated in FIG. 11A for reference. Pressure limiter 11" includes case means 54" and inner lower mandrel means 196" forming an enclosure means with an annulus 599 therein.

Case means 54" includes an upper pressure limiter case 600 connected to the lower end of piston seal case 180 at threaded connection 602. A seal 604 is provided therebetween. Upper pressure limiter case 600 defines a first bore 606 and a second bore 608. An annular recess 610 is disposed between first bore 606 and second bore 608, and the diameter of recess 610 is greater than second bore 608.

A pressure limiter case 612 is connected to upper pressure limiter case 600 at threaded connection 614. Referring also to FIG. 11B, pressure limiter case 612 defines at least one transverse hole 616 therethrough.

A diaphragm mandrel 618 is positioned annularly within diaphragm clamp 204. A plurality of outer splines 620 on diaphragm mandrel 618 engage inner splines 216 on diaphragm clamp 204 to prevent relative rotation therebetween.

Mandrel means 196" includes a pressure limiter mandrel 622 connected to diaphragm mandrel 618 at threaded connection 624. A seal 626 provides sealing engagement therebetween.

A pressure limiter piston means 627 is reciprocably disposed in annulus 599 between case means 54" and mandrel means 196". Piston means 627 includes a pressure limiter piston body 628 with an upper cylindrical end 629 in close relationship to second bore 608 of upper pressure limiter case 600. A seal 630 provides sealing engagement between upper end 629 of pressure limiter piston body 628 and upper pressure limiter case 600. An upper wiper ring 632 and a lower wiper ring 634 are provided for wiping piston body 628 clean of abrasives. Pressure limiter case 628 defines a transverse hole 636 therethrough.

Figure 11A:
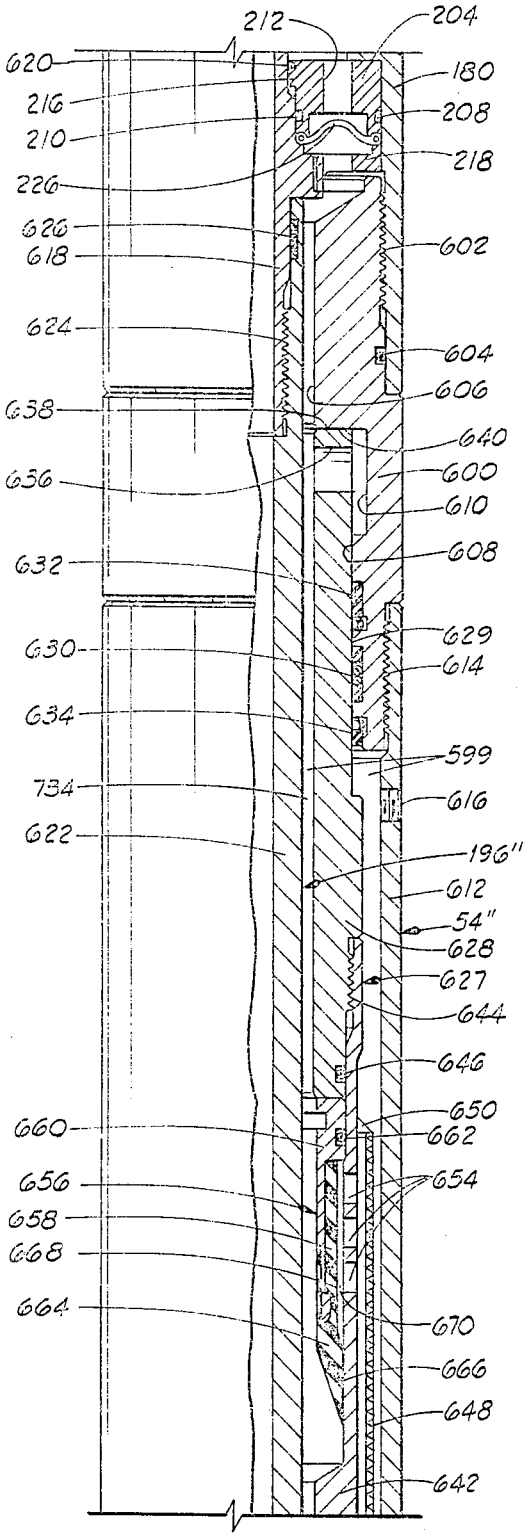
FIGS. 11A–11D illustrate the pump below the diaphragm with a third embodiment of the pressure limiter of the present invention.
Figure 11B:
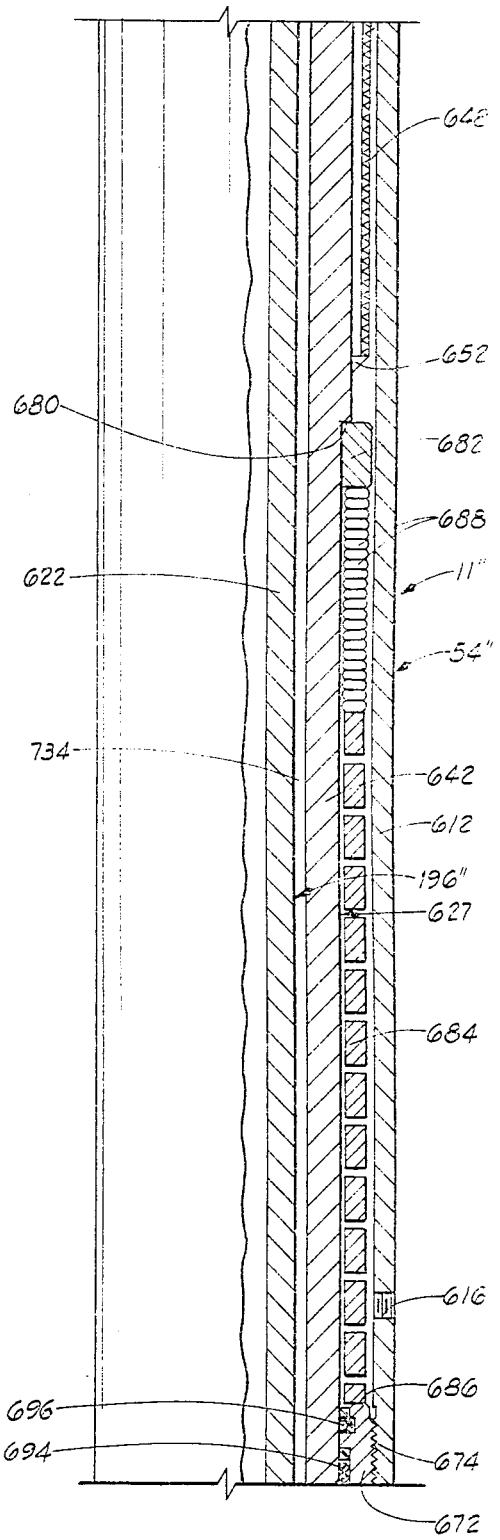

An upper face 638 on pressure limiter piston body 628 is adapted to engage a shoulder 640 in upper pressure limiter case 600 adjacent recess 610 when piston means 627 is in the uppermost position shown in FIG. 11A. In this position, hole 636 is adjacent recess 610.

A pressure limiter piston sleeve 642 is connected to the lower end of pressure limiter piston body 628 at threaded connection 644. A seal 646 is provided therebetween. Pressure limiter piston sleeve 642 provides an intake screen mandrel for an intake screen 648 which is positioned annularly therearound and attached thereto by welds 650 and 652. Intake screen 648 is spaced radially outwardly from pressure limiter piston sleeve 642. Pressure limiter piston sleeve 642 defines a plurality of transverse holes 654 therethrough adjacent the upper end of intake screen 648.

Inlet check valve means, generally designated by the numeral 656, is provided for controlling fluid flow through holes 654. Inlet check valve means 656 preferably comprises a resilient valve portion 658 carried by a valve portion carrier 660. Valve portion 658 and valve portion carrier 660 are annularly disposed between pressure limiter mandrel 622 and pressure limiter piston sleeve 642 and longitudinally immediately below pressure limiter piston body 628. A seal 662 is provided between valve portion carrier 660 and pressure limiter piston sleeve 642. Valve portion 658 has a resilient annular lip 664 having a radially outer surface 666 that is sealingly engaged against radially inner surface 668 of pressure limiter piston sleeve 642. Valve portion 658 is further configured such that an annular space 670 is defined between valve portion 658 and pressure limiter piston sleeve 642. It will be seen that annular space 670 is in communication with holes 654.

Figure 11C:
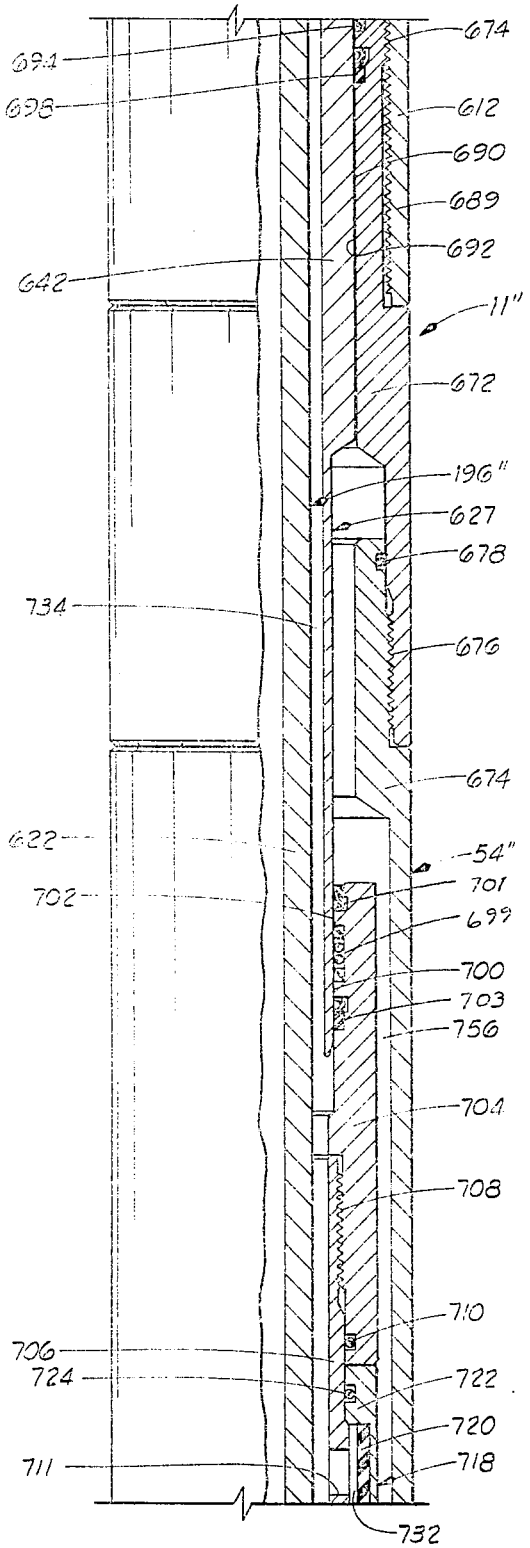

Referring now to FIGS. 11B and 11C, the lower end of pressure limiter case 612 is connected to a lower pressure limiter case 672 at threaded connection 674.

A check valve case 674 is connected to the lower end of lower pressure limiter case 672 at threaded connection 676. A seal 678 is provided therebetween.

A downwardly facing shoulder 680 on pressure limiter piston sleeve 642 of piston means 627 is engaged by a spring seat 682. A pressure limiter spring 684 engages a shoulder 686 in case means 54' which generally upwardly faces shoulder 680 on pressure limiter piston sleeve 642. A plurality of spring spacers 688 are provided between pressure limiter spring 684 and spring seat 682 for adjusting the preload provided by the spring on piston means 627.

It will be seen that threaded lower end 689 of pressure limiter case 612 is longer than is necessary to merely provide threaded connection 524. As with the second embodiment, this extra length allows easier assembly of pressure limiter case 612 with lower pressure limiter case 672 without the necessity of pre-compressing pressure limiter spring 684.

An intermediate cylindrical surface 690 of pressure limiter piston sleeve 642 is in close relationship with bore 692 of lower pressure limiter case 672. A seal 694 provides sealing engagement between outer surface 690 and bore 692. An upper wiper ring 696 and a lower wiper ring 698 are provided for wiping piston sleeve 642 clean of abrasives.

A lower cylindrical end 700 of pressure limiter piston sleeve 642 is in close relationship with bore 702 of check valve retainer 704. A seal 699 provides sealing engagement between outer surface 700 of pressure limiter sleeve 642 and bore 702 of check valve retainer 704. An upper wiper ring 701 and a lower wiper ring 703 are provided for wiping piston sleeve 642 clean of abrasives.

Check valve retainer 704 is connected to check valve seat 706 at threaded connection 708. A seal 710 is provided therebetween. A transverse hole 711 is defined in check valve seat 706.

Upper end 629 of pressure limiter piston body 628, intermediate surface 690 of pressure limiter piston sleeve 642 and lower end 700 of pressure limiter piston sleeve 642 may be characterized as first cylindrical portion 624, second cylindrical portion 690 and third cylindrical portion 700, respectively, of piston means 627.

Figure 11D:
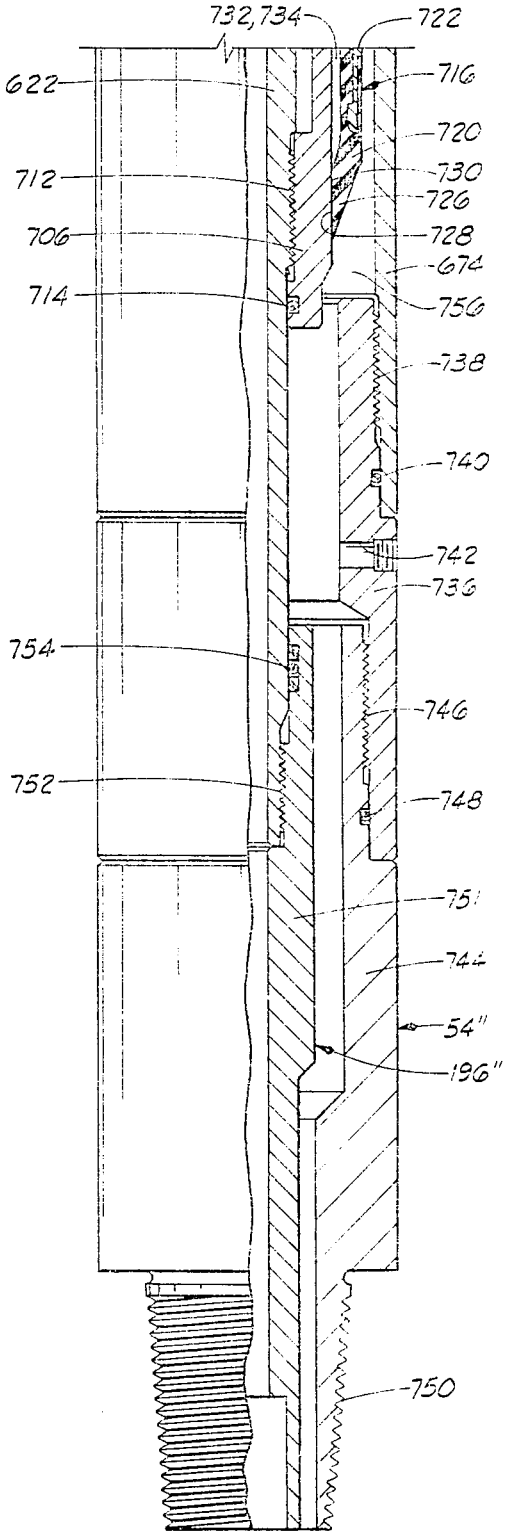

Referring now also to FIG. 11D, the lower end of check valve seat 706 is connected to pressure limiter mandrel 622 at threaded connection 712, and a seal 714 provides sealing engagement therebetween.

Outlet check valve means, generally designated by the numeral 718, is provided for controlling fluid flow through hole 711. Outlet check valve means 718 preferably includes a resilient annular valve portion 720 carried by a valve portion carrier 722. Valve portion carrier 722 is disposed longitudinally below check valve retainer 704 and annularly between check valve seat 706 and check valve case 674. A seal 724 is provided between valve portion carrier 722 and check valve seat 706. Valve portion 720 includes a resilient annular lip 726 having a radially inner surface 728 which sealingly engages a radially outer surface 730 of check valve seat 706. Valve portion 720 and check valve seat 706 are further adapted to define an annular space 732 therebetween which is in communication with hole 711.

It will be seen that a generally annular pumping chamber 734 is defined between pressure limiter mandrel 622 of mandrel means 196" on the inside and case means 54" and piston means 627 on the outside. Annular space 732 forms a lowermost portion of pumping chamber 734.

Referring now to FIG. 11D, the lower end of check valve case 674 is connected to a case adapter 736 at threaded connection 738. A seal 740 is provided therebetween. Case adapter 736 defines an exhaust test port 742 transversely therethrough. Port 742 is plugged during normal operation of the apparatus.

The lower end of case adapter 736 is attached to lower adapter 734 at threaded connection 746. A seal 748 is provided therebetween. Lower adapter 734 thus forms the lower end of case means 54". Lower adapter 734 has a threaded lower portion 750 which is adapted for connection to the lower portion of testing string 12 in a manner known in the art.

The lower end of pressure limiter mandrel 622 is connected to adapter mandrel 751 at threaded connection 752, and a seal 754 is provided therebetween. The lower end of adapter mandrel 751 is adapted for attachment to the lower portion of testing string 12 in a manner known in the art.

Referring again to 11C and 11D, an outlet chamber 756 is defined radially outwardly of outlet check valve means 716 and inside of case means 54". Outlet chamber 756 is in communication with the lower portion of testing string 12 including upper packer 32 and lower packer 34, just as with the other embodiments.

A fourth embodiment of the apparatus is not separately shown in the drawings, but is of substantially the same construction as the first embodiment 11 shown in FIGS. 2C–2F, except that no pressure limiter assembly 398 is used and the holes and porting associated therewith are also not present. In other words, the fourth embodiment includes an intake screen 272 through which fluid flows to an inlet check valve means 288 into a pumping chamber 234. At the lower end of pumping chamber 234 is an outlet check valve means 338. There is no pressure limiter assembly 398 between inlet check valve means 288 and outlet check valve means 338. Instead, in the fourth embodiment, the volume of pumping chamber 234 is of a predetermined size such that, as the pumping pressure increases with the corresponding decrease in pump efficiency, the pump efficiency will drop to essentially zero when the pump pressure reaches a predetermined level. In this way, pumping chamber 234 itself acts as the pressure limiter. Pump 10 thus becomes a variable efficiency pump.

OPERATION OF THE INVENTION

Pumping chamber 201 and equalizing chamber 102 below equalizing piston 104 are precharged with lubricating oil through holes 235 and 114, respectively, as already described. As testing string 12 is lowered into well bore 14, equalizing piston 104 is preferably at the uppermost position in equalizing chamber 102, as shown in FIG. 2B.

Testing string 12 is lowered until upper packer 32 and lower packer 34 are properly positioned on opposite sides of formation 16. In this position, upper adapter means 42 is spaced above case means 54, as illustrated in FIGS. 2A and 2B. In other words, splined portion 70 of torque mandrel 60 is in contact with shoulder 69 in torque case 50.

Drag springs 40 at the lower end of testing string 12 help center the apparatus and further prevent rotation of the lower portion of testing string 12. Because case means 54 and lower mandrel means 196 are attached to the lower portion of testing string 12, and because the case means and lower mandrel means are prevented from mutual rotation by inner spline 244 in splined upper pump brakeoff 237 and outer spline 244 on diaphragm mandrel 198, case means 54 and lower mandrel means 196 are also prevented from rotation by drag springs 40. Thus, it will be seen that by rotation of tool string 18, the upper portion of testing string 12 including upper adapter means 42 and upper mandrel means 58 of pump 10 will rotate with respect to case means 54 and lower mandrel means 196 of pump 10.

As lower mandrel means 58 is rotated, pump cam 136 is rotated with respect to pump piston 166. Of course, rotation of pump piston 166 is prevented by the interaction of splines 176 on the pump piston with splines 178 in spline piston case 142 of case means 54. As pump cam 136 is rotated, cam roller 169 and cam follower pin 168 will be moved cyclically between upper portions 158 and lower portions 160 of cam slot 156, resulting in reciprocation of pump piston 166 within piston chamber 201. Because cam slot 156 has two upper portions 158 and two lower portions 160, pump piston 166 will be cycled twice for each revolution of pump cam 136.

Downward movement of piston 166 within piston chamber 201 causes fluid movement in lower portion 202 of piston chamber 201 against diaphragm 226. Diaphragm 226 will flex downwardly in response to this fluid movement, and thus there will be a corresponding fluid movement downwardly in pumping chamber 234. Although piston chamber 201 and pumping chamber 234 are sealingly separated by diaphragm 226, pumping action will occur in pumping chamber 234 just as if pump piston 166 were in direct contact with the fluid therein. Further, if diaphragm 226 is damaged or leaks, wiper rings 188 and 192 act as back-ups to the diaphragm by wiping piston 166 and pump cam 136 free of abrasives so that pump 10 will still function. In such a case, the lubricating fluid in piston chamber 201 will be lost, and pump piston 166 will be in contact with, and directly pump against, well annulus fluid from pumping chamber 234 in a manner similar to pumps in the prior art.

As pump piston 166 moves upwardly in piston chamber 201, one-way check valves 394 will allow fluid in upper 203 of piston chamber 201 to bypass downwardly therethrough so that undesired pressure is not built up in upper portion 203 of the piston chamber. Thus, pump piston 166 pumps on the down stroke and bypasses on the up stroke of a reciprocation cycle.

When pump piston 166 is moved upwardly during a cycle, diaphragm 226 will correspondingly move upwardly. This results in a lowering of pressure in pumping chamber 234 below the fluid pressure in well annulus 284 which causes annular lip 296 of inlet check valve means 288 to deflect radially inwardly. Well annulus fluid thus enters pumping chamber 234 through hole 282, inlet chamber 280, intake screen 272, hole 286 and annular space 302. At the same time, fluid differential pressure across outlet check valve means 338 keeps annular lip 348 thereof sealingly enclosed. In other words, fluid only enters pumping chamber 234 through inlet check valve means 288.

On the down stroke of pump piston 166 in which diaphragm 226 is correspondingly moved downwardly, there is a resulting increase in pressure in pumping chamber 234. This increased pressure causes annular lip 296 of inlet check valve means 288 to be sealingly closed, and annular lip 348 of outlet check valve means 338 is opened by fluid flow from pumping chamber 234 through hole 336 and annular space 354 for discharge of the fluid from the pumping chamber into outlet chamber 340.

The continuous pumping action of pump piston 166 and diaphragm 226 thus causes pumping of fluid from well annulus 284 into outlet chamber 340 and from there downwardly through the lower portion of testing string 12 to inflate upper packer 32 and lower packer 34 into sealing engagement with well bore 14 adjacent well formation 16.

Once upper packer 32 and lower packer 34 are properly inflated, testing of fluids in well formation 16 may be carried out in a manner known in the art. Such fluids are carried upwardly through a central flow passageway in testing string 12 which includes central opening 444 of pump 10 and pressure limiter 11.

When pump 10 is not in operation, such as when testing string 12 is lowered into well bore 14 or removed therefrom, a hydrostatic pressure differential between pumping chamber 234 and piston chamber 201 across diaphragm 226 could cause a rupture in the diaphragm. This is prevented by an interaction between equalizing piston 104 in equalizing chamber 102 and visco-jet 392 and check valves 394 in piston 166.

As already indicated, equalizing piston 104 is at the uppermost point in equalizing chamber 102 as testing string 12 is lowered into well bore 14. The increased fluid pressure in well bore 14 causes a compression of the lubricating oil in equalizing chamber 102 and piston chamber 201. As this occurs, equalizing piston 104 will move downwardly in equalizing chamber 102. Well annulus fluid will enter the equalizing chamber above piston 104 through opening 96 in piston cap 82. Because of check valves 394, this increase in fluid pressure in equalizing chamber 102, and thus upper portion 203 of piston chamber 201 will be communicated to lower portion 202 of piston chamber 201. Inlet check valve means 288 will open as necessary to equalize the hydrostatic pressures in pumping chamber 234 and well annulus 284. Thus, hydrostatic pressures on each side of diaphragm 226 are equalized.

As testing string 12 is raised to test a shallower formation 16 or is removed from well bore 14, the hydrostatic fluid pressure in pumping chamber 234, which will be basically well annulus pressure, will be greater than the hydrostatic pressure in lower portion 202 of piston chamber 201. Unless flow control means is provided for allowing some upward movement of fluid past pump piston 166, diaphragm 226 could be ruptured. Visco-jet 392 solves this problem by allowing retarded fluid movement upwardly past piston 166 from lower portion 202 to upper portion 203 of piston chamber 201. Equalizing piston 104 will respond accordingly. Thus, hydrostatic fluid pressure is again equalized on both sides of diaphragm 226 which eliminates the possibility of rupture. The amount of fluid flow through visco-jet 392 will be so retarded as to be basically negligible during the relatively rapid movement of pump piston 166 during operation of pump 10.

During pumping operation, it is desirable to limit the pressure output by pump 10 so that over-inflation of upper packer 32 and lower packet 34 is prevented. In the prior art, such pressure limitation has been typically provided by relief valves which bypass fluid directly from the pumping chamber to the well annulus. In the first embodiment of pressure limiter 11 disclosed herein, in which fluid is bypassed directly between the pumping chamber and the outlet chamber, and thus directly between the pumping chamber and the lower portion of testing string 12, does not vent to well annulus 284. This basically results in a greatly increased volume of pumping chamber 234. This greatly reduces the ratio of the volume of a stroke of pump piston 166 to the volume of the pumping chamber. However, even if pressure limiter 11 becomes stuck in an open position, packers 32 and 34 will remain inflated because the fluid from the pumping chamber is not bypassed directly to the well annulus. In other words, the pumping system remains closed.

In the first embodiment of pressure limiter 11, shown in FIGS. 2E and 7–9, when the differential pressure between outlet chamber 340 and well annulus 284 exceeds a predetermined level, pressure limiter piston 418 will be moved to an open position away from seat portion 404 of pressure limiter body 304, thus opening hole 406 and providing communication between pumping chamber 234 and outlet chamber 340 through the fluid passageway system hereinbefore described. As long as fluid pressure in outlet chamber 340 is sufficiently greater than the fluid pressure in well annulus 284 to overcome the force of spring 426, pressure limiter piston 418 will remain opened, effectively bypassing outlet check valve means 338. A study of FIG. 7 will show that this fluid differential pressure acts across the area sealed by seal 420 in piston bore 412 of pressure limiter housing 400. When the force of the pressure differential across this area drops below the force of spring 426, piston 418 will move to its closed position sealingly engaged against seat portion 404 of pressure limiter body 304, thus again closing pressure limiter 11.

In the second embodiment of pressure limiter 11' shown in FIGS. 10A–10D, pumping occurs through inlet check valve means 506 and outlet check valve means 568 in pumping chamber 584 in the same manner as the first embodiment. It will be seen that an annular area is defined between first cylindrical portion 477 of piston means 475 and second cylindrical portion 546 of the piston means. A study of FIGS. 10A–10D by those skilled in the art will show that the fluid pressure in pumping chamber 584 acts on this annular area on the inside of piston means 475 and well annulus pressure in inlet cavity 556 acts in an opposite direction on the annular area on the outside of the piston means.

As the pressure in pumping chamber 584 is gradually increased during a pumping cycle for inflating upper packer 32 and lower packer 34, obviously the pumping chamber pressure is increased above the pressure in the well annulus. When the differential between the pumping chamber pressure and the well annulus pressure acting on the annular area exceeds the force acting upwardly on piston means 475 by springs 536 and 538, the piston means will be actuated by moving downwardly. Piston means 475 moves gradually as the pressure differential increases. This gradual downward movement increases the volume in pumping chamber 584. It will be seen by those skilled in the art that piston means 475 will move downwardly to a position at which the increase in volume in pumping chamber 584 is approximately equal to the displacement through one stroke of pump 10. On the upstroke of pump 10, piston means 475 will return to its original, normal position. On the next stroke, the piston will reciprocate again. In this way, outlet check valve means 568 is rendered substantially inoperative, and there will be no further increase in pressure in pumping chamber 584, and thus no further increase in the pressure in upper packer 32 or lower packer 34.

As with the first embodiment, it is an important aspect of the second embodiment that no fluid in pumping chamber 584 is vented to well annulus 284. Thus, packers 32 and 34 will remain inflated.

In the third embodiment of pressure limiter 11" shown in FIGS. 11A–11D, the construction is similar to that in the second embodiment as already described. Also, pumping action through inlet check valve means 656 and outlet check valve means 718 in pumping chamber 734 is substantially the same as already described.

It will be seen that an annular area is defined between first cylindrical portion 629 and third cylindrical portion 700 of piston means 627 against which pressure in pumping chamber 734 acts downwardly on the inside of the piston means. Another annular area is defined between first cylindrical portion 629 and second cylindrical portion 690 of piston means 627 against which well annulus fluid pressure acts on the outside of the piston means. Finally, packer pressure in outlet chamber 756 acts on an annular area between second cylindrical portion 690 and third cylindrical portion 700 of piston means 627 on the outside of the piston means.

A study of FIGS. 11A–11D by those skilled in the art will show that when the pump pressure and packer pressure are equal, as is substantially the case after a complete pumping cycle, there is a net annular area between first cylindrical portion 629 and second cylindrical portion 690 of piston means 627 against which the differential between the pump pressure and pressure in well annulus 284 downwardly acts. Thus, as with the second embodiment, piston means 627 will be actuated to increase the volume of pumping chamber 734 when the differential between the pump pressure and well annulus pressure acting on the annular area between first cylindrical portion 629 and second cylindrical portion 690 of piston means 627 exceeds the force acting upwardly on the piston means by spring 684.

As with the second embodiment, the movement of piston means 627 will be gradual as the pressure increases. However, the fact that packer pressure is acting upwardly on piston means 627 allows a spring with less force to be used than with the second embodiment. Thus, the additional pressure necessary to move piston means 627 to the fully open position is less. Also, the stroke of piston means 627 in the third embodiment is less than the stroke of piston means 475 in the second embodiment. Because of the shorter stroke, and because less additional pressure is required results in pressure limiter 11" being actuated to the fully open position much more quickly than second embodiment 11'. Other than this distinction, the third embodiment of the pressure limiter 11" functions in substantially the same manner as second embodiment 11'.

As already indicated, pumping chamber 234 in the fourth embodiment is of a predetermined size such that the efficiency of pump 10 drops essentially to a level of zero when the desired predetermined pump pressure is reached. Thus, the fourth embodiment achieves the same ultimate result as the first, second and third embodiments, while having no pressure limiter piston at all. The apparatus for the fourth embodiment is thus obviously less complex than the other embodiments.

Once testing of fluids in well formation 16 is completed, upper packer 32 and lower packer 34 are deflated by actuating packer bypass 226. Such a packer bypass 226 is described in co-pending application Ser. No. 940,882, filed Dec. 10, 1986, a copy of which is incorporated herein by reference. Other methods of deflating packers 32 and 34 known in the art may also be used, and pump 10 is not limited to any particular deflating method.

When it is desired to have rotation below pump 10, such as to operate safety joint 30 in a situation where the tool string is stuck, tool string 18 may be lowered until lugs 71 on torque case 50 of upper adapter means 42 engage lugs 98 on piston cap 82 of case means 54. When lugs 71 and 98 are so engaged, it will be seen that rotation of tool string 18 and adapter means 42 will result in rotation of case means 54 and the portion of testing string 12 below pump 10 and above safety joint 30. The torque applied by rotation in such a manner is generally sufficient to index safety joint 30 which is of a kind known in the art.

It will be seen, therefore, that the pressure limiter of the testing apparatus of the present invention is well adapted to carry out the ends and advantages mentioned, as well as those inherent therein. While four presently preferred embodiments of the pressure limiter have been described for the purposes of this disclosure, numerous changes in the construction and arrangement of the parts may be made by those skilled in the art. All such changes are encompassed within the scope and spirit of the appended claims.

What is claimed is:

1. A pressure limiter apparatus for use in a well testing string having a positive displacement pump including a fluid displacement element, said apparatus comprising:

enclosure means in said well testing string having a wall defining a pumping chamber adjacent said pump and in pressure transmitting communication with said fluid displacement element;

inlet valve means associated with said enclosure means for controlling flow of fluid from a well annulus into said pumping chamber;

outlet valve means associated with said enclosure means for controlling flow of fluid from said pumping chamber to a lower well testing string portion; and pressure limiting means in communication with said pumping chamber for increasing the volume of said pumping chamber when a positive fluid pressure differential between said pumping chamber and said well annulus exceeds a predetermined value and for preventing venting of said fluid in said pumping chamber to said well annulus when said volume is so increased.

2. The apparatus of claim 1 wherein said pressure limiting means is disposed substantially between said inlet and outlet valve means.

3. The apparatus of claim 1 wherein said enclosure means further includes a hole through the wall thereof providing communication between said pumping chamber and said lower testing string portion through bypass passage means defining a flow path bypassing said outlet valve means and said pressure limiter means comprises:

a piston sealingly closing said hole to said bypass passage means when in a normal operating position and opening said hole to said bypass passage means when in an actuated position such that said pumping chamber and said lower testing string portion are in communication; and biasing means for biasing said piston toward said normal operating position.

4. The apparatus of claim 1 wherein said pressure limiting means comprises:

piston means reciprocably disposed in said enclosure means and having a first portion and a second portion relatively smaller than said first portion such that an annular area is defined between said first and second portions, said piston means being movable in response to pumping action of said pump such that said volume of said pumping chamber is increased by an amount approximately equal to a displacement of said pump;

first sealing means for sealingly separating said pumping chamber and said well annulus adjacent said first portion of said piston means; and second sealing means for sealingly separating said pumping chamber from said well annulus adjacent said second portion of said piston means.

5. The apparatus of claim 4 further comprising biasing means for biasing said piston means toward a position minimizing said volume of said pumping chamber.

6. The apparatus of claim 4 wherein:

said piston means includes a third portion relatively smaller than said second portion such that another annular area is defined between said second and third portions in communication with said lower testing string portion;

said second sealing means is further adapted for sealingly separating said well annulus and said lower testing string portion; and said pressure limiting means further comprises third sealing means for sealingly separating said pumping chamber and said lower testing string portion adjacent said third portion of said piston means.

7. The apparatus of claim 4 wherein said inlet valve means is mounted on said piston means.

8. The apparatus of claim 7 further comprising filtering means on said piston means for filtering said fluid in said well annulus flowing to said inlet valve means.

9. A pressure limiting apparatus comprising:

a case having an upper end adapted for attachment to a pump in an upper testing string portion and a lower end adapted for attachment to a lower testing string portion, said case defining a transverse hole therethrough between said upper and lower ends;

an inner mandrel having an upper end adapted for attachment to a mandrel in said upper testing string portion and a lower end adapted for attachment to a mandrel in said lower testing string portion, said case and mandrel defining an annulus therebetween;

an inlet check valve disposed in said annulus and defining an inlet chamber portion of said annulus in communication with said hole in said case;

an outlet check valve disposed in said annulus and defining an outlet chamber portion of said annulus in communication with said lower testing string portion, said inlet and outlet check valves defining a pumping chamber portion of said annulus therebetween, said pumping chamber opening adjacent said pump;

a piston reciprocably disposed in said annulus between a normal position and an actuated position, said piston comprising:

a first cylindrical portion; and a second cylindrical portion relatively smaller than said first cylindrical portion such that an annulus area is defined therebetween, said annular area being exposed to well hydrostatic pressure in said inlet chamber on an outer side of said piston and exposed to pumping chamber pressure on an inner side of said piston; and biasing means for biasing said piston toward said normal position;

wherein, said piston is moved from said normal position to said actuated position when a differential pressure level between said pumping chamber and said inlet chamber acting on said annular area overcomes a force exerted by said biasing means, movement of said piston increasing a volume of said pumping chamber by an amount approximately equal to a displacement of a pump in said upper testing string portion such that said outlet check valve is rendered inoperative.

10. The apparatus of claim 9 wherein said inlet check valve is mounted on said piston.

11. The apparatus of claim 9 further comprising:

first sealing means for sealing on said first cylindrical portion of said piston between said pumping chamber and said inlet chamber; and second sealing means for sealing on said second cylindrical portion of said piston between said pumping chamber and said inlet chamber.

12. The apparatus of claim 9 wherein:

said case has a shoulder thereon in said inlet chamber;

said piston has a shoulder thereon in said inlet chamber and generally facing said shoulder on said case; and said biasing means is characterized by at least one spring annularly positioned in said inlet chamber between said shoulders.

13. The apparatus of claim 12 further comprising a plurality of spacers between said spring and at least one of said shoulders for selectively increasing a preload of said spring.

14. The apparatus of claim 9 further comprising an inlet screen mounted on said piston for filtering fluid flowing from said inlet chamber to said inlet check valve.

15. The apparatus of claim 9 wherein said piston further includes a third cylindrical portion relatively smaller than said second cylindrical portion thereof.

16. The apparatus of claim 15 further comprising:

first sealing means for sealing on said first cylindrical portion of said piston between said pumping chamber and said inlet chamber;

second sealing means for sealing on said second cylindrical portion of said piston between said inlet chamber and said inlet chamber; and third sealing means for sealing on said third cylindrical portion of said piston between said pumping chamber and said outlet chamber.

17. The apparatus of claim 9 wherein:

said inlet check valve comprises a resilient valve portion having an annular lip thereon sealingly engaged with a surface of said pumping chamber when in a closed position; and said outlet check valve comprises a resilient valve portion having an annular lip thereon sealingly engaged with a surface of said pumping chamber when in a closed position.

18. A downhole testing tool for use on a testing string in a well annulus and having a central flow passageway therethrough, said tool comprising:

a tester valve;

a positive displacement pump positioned below said tester valve;

a packer disposed below said pump and positionable in said well annulus above a formation to be tested, said packer being inflatable by said pump into sealing engagement with said well annulus;

a pressure limiter between said pump and said packer for limiting pressure in said pump and packer and preventing overinflation of said packer, said pressure limiter defining a pumping chamber therein adjacent and in pressure transmitting communication with said pump and comprising:

an inlet valve for allowing fluid flow from said well annulus into said pumping chamber;

an outlet valve for allowing fluid flow from said pumping chamber to said packer; and means for internally bypassing said outlet valve when a positive differential between pressure in said pump and pumping chamber and pressure in said well annulus adjacent thereto exceeds a predetermined level; and a porting sub positionable adjacent said formation for allowing well fluid flow therethrough into said central flow passageway in response to actuation of said tester valve during a testing operation.

19. The testing tool of claim 18 wherein said fluid flows from said pumping chamber is continuously sealingly separated from said well annulus.

20. The testing tool of claim 18 wherein said means for bypassing is characterized by a reciprocable piston in said pumping chamber, said piston being movable such that said volume of said pumping chamber is increased by an amount approximately equal to a displacement of said pump.

* * * * *